US011688368B2

(12) United States Patent
Walker

(10) Patent No.: US 11,688,368 B2
(45) Date of Patent: Jun. 27, 2023

(54) VIBRATO ARM AND SYSTEM

(71) Applicant: TECHNOLOGY CONNECTIONS INTERNATIONAL PTY LTD, Sydney (AU)

(72) Inventor: Peter Joseph Walker, Sydney (AU)

(73) Assignee: TECHNOLOGY CONNECTIONS INTERNATIONAL PTY LTD

( * ) Notice: Subject to any disclaimer, the term of this patent is extended or adjusted under 35 U.S.C. 154(b) by 274 days.

(21) Appl. No.: 17/204,883

(22) Filed: Mar. 17, 2021

(65) Prior Publication Data

US 2021/0201857 A1 Jul. 1, 2021

Related U.S. Application Data

(62) Division of application No. 15/559,675, filed as application No. PCT/AU2016/050199 on Mar. 21, 2016, now Pat. No. 10,978,029.

(30) Foreign Application Priority Data

Mar. 20, 2015 (AU) ..... 2015901017

(51) Int. Cl.

| | |
|---|---|
| ***G10D 3/153*** | (2020.01) |
| ***G10H 1/055*** | (2006.01) |
| ***G10H 1/053*** | (2006.01) |

(52) U.S. Cl.

CPC ..... *G10D 3/153* (2020.02); *G10H 1/0535* (2013.01); *G10H 1/0555* (2013.01); *G10H 2210/201* (2013.01); *G10H 2210/211* (2013.01); *G10H 2220/521* (2013.01)

(58) Field of Classification Search

CPC .... G10D 3/153; G10H 1/0535; G10H 1/0555; G10H 2210/201; G10H 2210/211; G10H 2220/521

See application file for complete search history.

(56) References Cited

U.S. PATENT DOCUMENTS

| | | | | |
|---|---|---|---|---|
| 3,124,991 | A * | 3/1964 | Costen | G10D 3/153 84/267 |
| 3,142,221 | A * | 7/1964 | Boyd | G10D 3/153 84/267 |
| 4,648,304 | A * | 3/1987 | Hoshino | G10D 3/153 84/297 S |
| 7,049,504 | B1 * | 5/2006 | Galoyan | G10H 3/186 84/313 |
| 7,435,178 | B1 * | 10/2008 | Tam | A63F 13/814 84/743 |

* cited by examiner

*Primary Examiner* — Jianchun Qin
(74) *Attorney, Agent, or Firm* — Shutts & Bowen LLP

(57) ABSTRACT

A manual vibrato control device, system and processing arrangement are disclosed. A manual vibrato includes a rotatable shaft, a raised cam section on the shaft, first and second biased collars received on the shaft either side of the cam section, the bias of the first collar being rotationally opposite to the bias of the second collar such that as the shaft rotates in one direction, it receives a return force from the first collar but does not rotate the second collar, and vice versa. Also disclosed are processing techniques to take the rotational data from rotational sensors, preferably Hall Effect, on the shaft and generate pitch change instructions for a pitch modification device. The mapping is user controllable to produce desired effects and performance.

13 Claims, 15 Drawing Sheets

VIBRATO ARM AND SYSTEM

CROSS REFERENCE TO RELATED APPLICATIONS

This Non-provisional Application is a divisional of U.S. patent application Ser. No. 15/559,675 entitled VIBRATO ARM AND SYSTEM, filed Sep. 19, 2017, which is a 35 USC Sect. 371 National Stage entry of PCT/AU/2016/050199 entitled VIBRATO ARM AND SYSTEM, filed Mar. 21, 2016, which claims the benefit of Australian Application No. 2015901017, filed on Mar. 20, 2015, the entireties of which are incorporated herein by reference.

TECHNICAL FIELD

The present invention relates to the provision of a vibrato function for a musical instrument, particularly a stringed instrument such as a guitar.

BACKGROUND OF THE INVENTION

Guitars have been an important musical instrument in popular Western music for over 70 years. The electric guitar has been widely used, modified, and the outputs signals subjected to a wide variety of electronic modification. For example, many of the distinctive effects of electric guitar players are the result of the use of specially designed pedals and other modification devices. These, coupled with the skill and ability of the artist, allow for an enormous range of effects, sounds and playing styles.

Another aspect of the performance dynamic of many guitar players is the use of the whammy bar, or vibrato arm. This allows for the pitch of a note to be varied about the regular value of the note. The term is widely used in string instruments, for example in relation to violins, and in relation to the human voice. It is noted that this component is in many cases in the guitar context referred to in error as a tremolo arm, tremolo being in fact the variation of amplitude rather than pitch or frequency. The present invention is concerned with the provision of a vibrato device for guitars and other musical instruments.

Vibrato devices for electric guitars have been known since the 1930s, and came into widespread use through the 1950s and 1960s. The existing vibrato arms in use are all mechanical in nature. In essence, they alter the pitch of the strings using a mechanical system to decrease or increase the tension of the strings, with a corresponding decrease or increase in pitch. Changing the pitch in this way has a number of inherent drawbacks.

A particular issue is that any or all of the strings may not return to exactly the correct pitch when the vibrato arm is released. The stressing of the strings, errors inherent in the return-to-centre mechanical design and the potential for strings to bind in the nut or bridge during manipulation are the underlying causes of this issue. These factors can produce unwanted alterations in string tension, affecting the instrument's tuning. Correct tuning is a matter of high precision and technical understanding, complicated by the requirement that the instrument must be correct in its absolute pitch, while maintaining precise relative pitch across all strings on the instrument. This makes tuning a complex process, with errors particularly obvious when there are two instruments playing together, as in this case any discrepancies are even more apparent.

The tension change inherent in operation of a vibrato arm also imposes strain on the neck, strings and body of the instrument. This limits the degree of pitch change which is possible, as well as the types of instrument which can have a vibrato bar installed. For example, the mechanical and structural requirements of vibrato systems have generally precluded their use on acoustic guitars.

Various attempts to resolve these problems have been proposed, for example as outlined at http://en.wikipedia.org/wiki/Vibrato_systems_for_guitar. These include the floating bridge (Stratocaster®), rotating string guides (Bigsby), Locked strings (Floyd Rose), multi-leveraged systems (Wilkinson at al).

Whilst providing improvements in some respects over the prior art systems, all such systems suffer from the need to impose complex mechanical systems simply in order to compensate for the deficiencies in a mechanical approach to vibrato.

More recently, electronic devices, controlled by footpedals or switches, have permitted pitch changes to be applied to the output of an electric guitar, typically using a digital signal processing (DSP) approach. While such a system is capable of producing pitch changes, the use of a foot pedal or switch by the artist does not allow for the level of fine control or expression which is provided by a vibrato arm. Further, foot control methods—pedal up: no change, pedal down: maximum change—allow pitch alteration in only one direction at a time. This limitation is inherent in switch control.

Some disclosures in the prior patent literature disclose the principle of using a mechanical vibrato arm, so as provide control of an electronic pitch control device and thereby provide the benefits of mechanical, hand controlled vibrato mechanism without a mechanical connection to the strings of the instrument.

For example, U.S. Pat. No. 5,631,435 by Hutmacher discloses a photoelectric sensor for movement of a mechanical vibrato arm, with the arm being held between the tension of coil springs, so as to allow for the return of the arm to a central position.

U.S. Pat. No. 7,049,504 to Galoyan discloses an arrangement using a shaft and torsion springs to return the vibrato arm to the central position. In this case, the positon is sensed using rotation of a potentiometer.

WO 2005104089 by Ruokangas et al discloses the general idea of a vibrato arm operating mechanically and controlling the vibrato using an effects unit. The vibrato arm disclosed uses compression springs, and a variety of different possible sensors for the rotational position of the arm.

None of the patent references above appears to have entered into commercial use. In various respects, all these disclosures fail to define a system which is capable of precise, repeatable operation by the player.

It is an object of the present invention to provide a vibrato device which is capable of precise, repeatable operation by a player.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

SUMMARY OF THE INVENTION

In a first broad form, the present invention provides a vibrato control device with an arm, and sensors to detect the position of the arm. This position data is sent to a control device, which processes the data to provide input to a pitch control device.

In one aspect, the present invention provides a manual vibrato system, including a manually operated vibrato control device having an arm, a rotation sensor to sense rotation of the arm and produce rotation data, and a processor receiving said data and being adapted to send pitch change instructions to a pitch modification device.

According to another aspect, the present invention provides a method for providing vibrato, including receiving rotation data from a manually operated vibrato control device having an arm, the rotation data being indicative of the rotation of the arm, and processing said rotation data so as to pitch change instructions for a pitch modification device.

According to another aspect, the present invention provides a manual vibrato control device for use with an electronic pitch modification device, wherein the device includes a rotatable shaft, a raised cam section on the shaft, first and second collars received on the shaft either side of the cam section, each collar being rotatable relative to the shaft and having a resilient bias urging it towards a central position, the bias of the first collar being rotationally opposite to the bias of the second collar, the first and second collars and the cam section engaging at respective surfaces such that as the shaft rotates in one direction, it receives a return force from the first collar but does not rotate the second collar, and that as the shaft rotates in the second, opposite direction, it receives a return force from the second collar but does not rotate the first collar According to another aspect, the present invention provides a manual vibrato control device, including a rotatable shaft, an arm received on the shaft, two magnets arranged in or adjacent to the shaft and having oppositely directed polarities, and a Hall effect sensor positioned stationary relative to the rotation of the shaft, such that magnets rotate with the shaft, and the sensor measures changes in the value and polarity of the magnetic field to produce rotation data indicative of the rotational position of the shaft According to another aspect, the present invention provides a method of sensing the position of a rotatable shaft, including providing two magnets arranged in or adjacent to the shaft and having oppositely directed polarities, providing a Hall effect sensor positioned stationary relative to the rotation of the shaft, such that magnets rotate with the shaft, the sensor measures changes in the value and polarity of the magnetic field, to thereby produce rotation data indicative of the rotational position of the shaft.

According to another aspect, the present invention provides a manual vibrato control device including a rotatable shaft, a raised cam section on the shaft, a first collar received on the shaft and engaging first cam section, a second collar received on the shaft and engaging a second cam section, each collar being rotatable relative to the shaft and having a resilient bias urging it towards a central position, the bias of the first collar being rotationally opposite to the bias of the second collar, the first and second collars and the first and second cam sections engaging at respective surfaces such that as the shaft rotates in one direction, it receives a return force from the first collar but does not rotate the second collar, and that as the shaft rotates in the second, opposite direction, it receives a return force from the second collar but does not rotate the first collar.

Implementations allow for a mechanism that provides a return to centre function in a reliable, precise way, which is not closely dependent upon the bias applied to the first and second collar being exactly the same.

Implementations of the present invention accordingly allow for a precise and accurate centering mechanism, and reliable position information to the collected. Processing of the position data, and user selectable parameters, allow for a player centric vibrato system, which is fully electronic in processing, yet retains the ability for excellent player control and dynamics.

BRIEF DESCRIPTION OF THE DRAWINGS

An illustrative embodiment of the present invention will now be described with reference to the accompanying figures, in which.

DETAILED DESCRIPTION OF THE INVENTION

Figure 1:
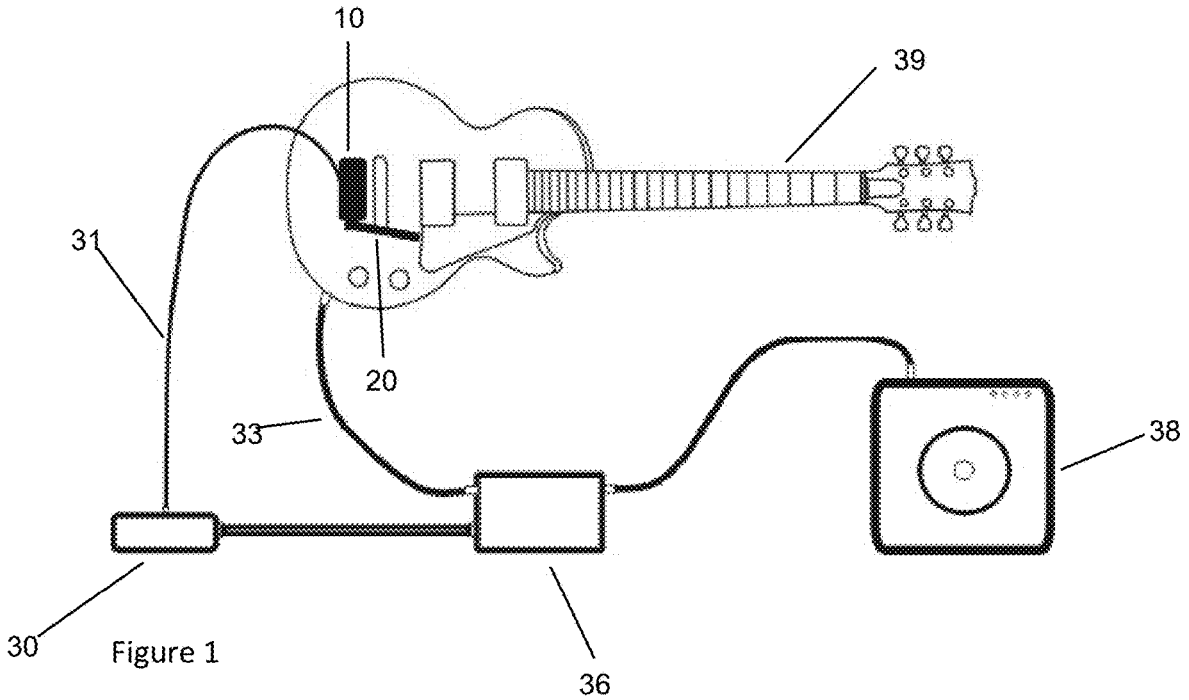
FIG. 1 is a general view illustrating an embodiment of the present invention with a guitar.

The following examples and implementations are intended to be illustrative and not limitative in nature. It is noted in particular that there are various inventive concepts disclosed, which may be used together or, in many cases, separately and produce significant advantages over the existing devices. Thus, the components of the overall illustrative embodiment may be utilised separately or in their various combinations. In particular, implementations may include some or all of the software features described.

In the figures, like reference numerals are used to identify like parts throughout the figures.

The present invention will be described primarily with reference to 6 string electric and acoustic guitars. It may be applied to 4, 6, 7, 8 or 12 string guitars. However, the present invention is adapted to be implemented using other instruments, particularly stringed instruments such as bass guitars, mandolins, and other forms of guitars and similar instrument. With suitable modifications, aspects of the present invention are applicable to any desired musical instrument.

It will also be appreciated that while the present invention is primarily described with reference to an add-on device, the various aspects of the present invention may be integrated with other devices at the time of manufacture. For example, the vibrato arm could be fitted at the time of manufacture onto a guitar, or the vibrato box could be integrated into a guitar, an amplifier, an effects unit, or a pitch control unit. However, for convenience and clarity, these will be described as elements added to an existing guitar set up.

The system described is envisaged for use with a conventional electric guitar. The guitar would have an associated amplifier, and in most cases one or more effects pedals or other devices to modify the output of the guitar or the amplifier. These conventional aspects do not require change and will not be discussed in detail. The invention may be applied to any conventional guitar or related accessories. In particular, the present invention may be applied to acoustic instruments, as well as electric instruments.

The present invention has several aspects which are specifically directed at ensuring that the vibrato arm returns to the correct position, and ensuring that the small variations (as will be explained in more detail below) are managed and processed by the software in order to produce a musical outcome which is intended by the player.

Further aspects are directed at features which enable improved performance, and to provide additional options and features for the player to utilise.

FIG. 1 illustrates generally the application of a vibrato device 10 according to the present invention to a guitar. Vibrato device 10 is affixed to the guitar 39 behind the bridge of guitar 39. Vibrato device 10 includes an arm 20 which is adapted to be rotated, as will be explained further below.

The guitar is shown connected via conventional lead 33 to a pitch control device 36. This in turn outputs to an amplifier 38. The vibrato device 10 is connected via lead 31 to control box 30, which in turn is connected via a MIDI connection to pitch control unit 36. It is emphasised that in the preferred implementation, vibrato device 10 and control box 30 are not interposed in any way between the guitar and the amplifier. Hence, when pitch control unit 36 is in true bypass mode, the guitar signal will go straight to the amplifier.

Figure 2:
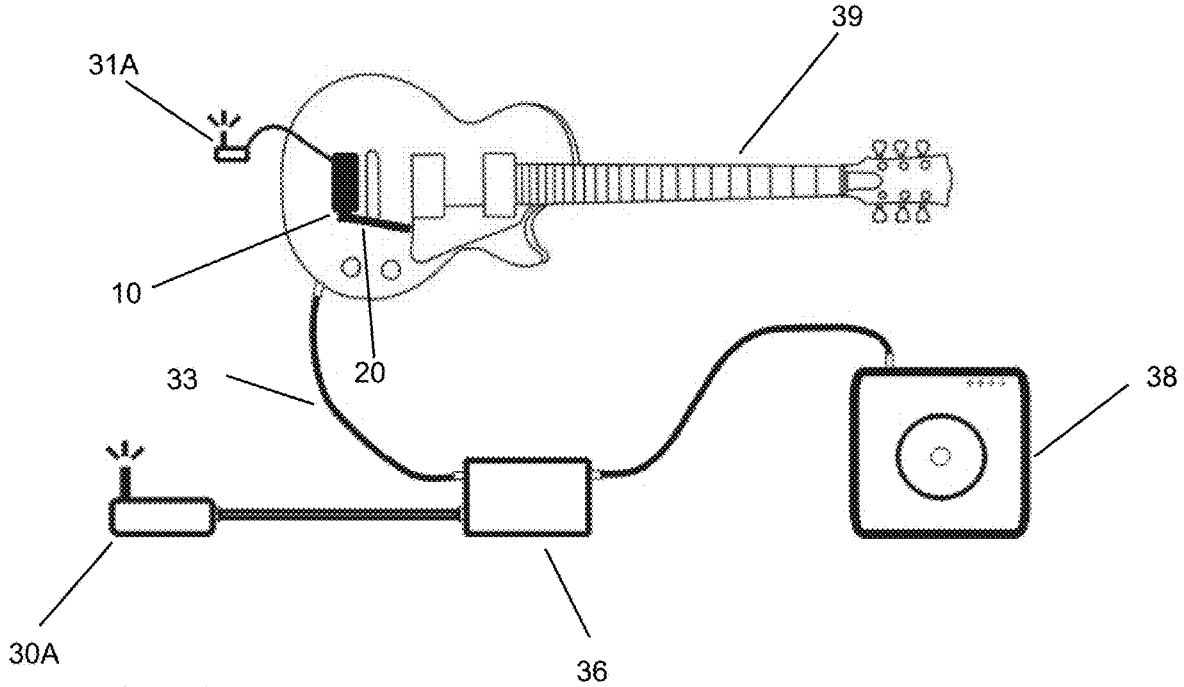
FIG. 2 illustrates schematically a similar arrangement to FIG. 1, but using a wireless connection.

In an alternative implementation, shown in FIG. 2, the vibrato device 10 includes a wireless communication system 31A, for example Bluetooth or Wi-Fi. A suitable receiver 30A is provided at the control box 30, so that the data from vibrato device 10 can be sent wirelessly to control box 30. It will be appreciated that the vibrato device would need a battery in this implementation.

It will be appreciated that the affixing arrangement is purely to stabilise the arm so that the device can be played. The torsion springs do not impose anything like the load of a conventional vibrato system, in which the player is in one way or another working against the combined tension of the guitar strings and the heavy return springs of the mechanism. Thus, the structural requirements are minimal, as there is no large stress being exerted against the tension of the strings which needs to be supported by the guitar. As a result, this system is readily applicable to lighter construction instruments, for example acoustic guitars and other string instruments.

Figure 16A:
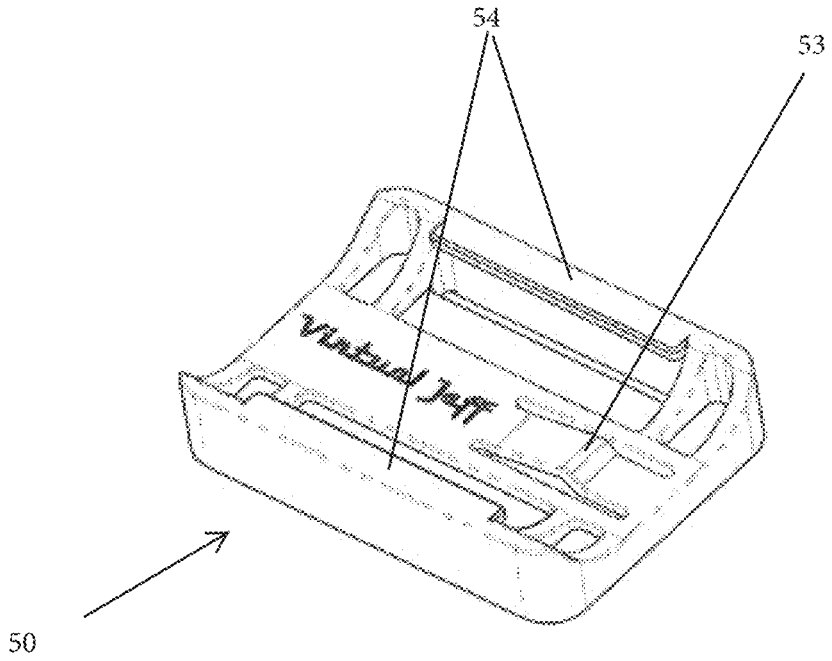
FIGS. 16A and 16 B are views of a mount for a device according to the present invention.
Figure 16B:
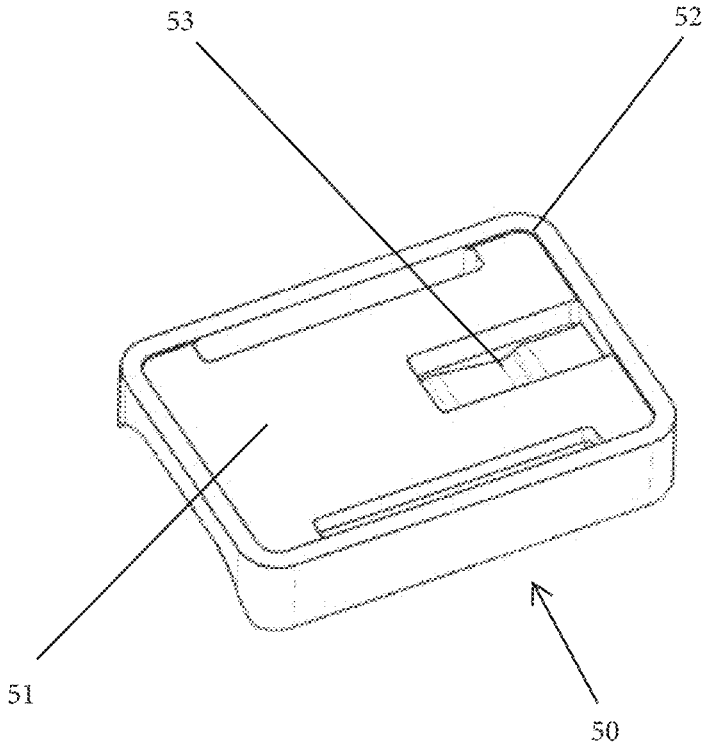

A universal mount may be used to fit practically any guitar, electric or acoustic. Referring to FIGS. 16A and 16 B, a mount 50 can be seen. In FIG. 16A, the lower surface 52 which affixes to the guitar is visible, as well as an area of adhesive, provided by double sided tape or other suitable techniques. Because of the internal design of the moving parts according to this implementation, the tape doesn't have to withstand high separation forces. The moments of the forces are distributed, so the bonding required is relatively low.

In FIG. 16A, the upper side of the mount is visible. The underside of the body of the vibrato device according to the present implementation has grooves which slide into captivating rails 54 on the mount. An advantage of this arrangement is that multiple mounts can be affixed to different guitars, so that the vibrato device can be moved as required. Alternatively, guitars could include an integrated mount. Of course, in suitable implementations any desired mount could be used.

FIG. 2 illustrates the connections between vibrato device 10, the control box 30, the guitar and the pitch change device. The illustrated implementation uses a vibrato control box 30 to receive signals from the vibrato device 10 (as will be described below) and to process those signals to produce data for a pitch change device 36.

In a preferred implementation, the pitch change device is a commercially available unit, such as the Digitech Whammy V, which accepts a MIDI (Musical Instrument Digital Interface) input. MIDI is a well-known protocol for connecting musical devices (e.g. keyboards) with electronic units (e.g. samplers). The protocol is well understood and widely practiced in the industry, and is described in more detail at, for example, http://www.midi.org/techspecs/, the contents of which are hereby incorporated by reference. As this is in effect an industry standard, this will not be further disclosed in detail.

Of course, whilst this is the preferred arrangement, other modes and techniques than the MIDI approach described could be used to connect control box 30 to pitch change device 36.

The MIDI protocol includes Program Changes—to change from one program to another in a switching fashion—and Control Changes, which allow for (analog/proportional) value changes to be sent and decoded. The control box 30 uses both aspects.

Control box 30 incorporates a microprocessor, for example an ATmega328 by Atmel. This processor has an internal analog-to-digital converter, necessary to translate the variable voltage from a sensor to digital data for processing. The control box also includes switches and LED indicators, for user control and status feedback. The microprocessor is preferably adapted to output MIDI signals to the pitch change device but can also be adapted to other output formats like control voltage (CV), RS232/485 serial and the like.

In outline, the flow-path of operation of the control box is as follows:

1) A sensor detects movements of the vibrato lever.
2) The sensor produces a variable analog voltage proportional to the movement.
3) The microprocessor converts that analog voltage to digital data.
4) The microprocessor uses algorithms to modify the data to provide various operational features and enhancements.
5) Before it is passed to the next stage, the data is formatted to match the control method of the selected pitch change DSP, in this example, MIDI data.

It is noted that the nature and origin of the analog voltage will be explained further below. This flow-path is applicable to a variety of: rotation/movement detection methods; sensors and mounting geometries; microprocessors; output format requirements.

Control box 30 has power supply filtering and regulation such that it can be powered from any standard 9 Vdc musical instrument plugpack. Battery operation is also possible as current requirements are low (<40 mA).

Control unit 30 also has various set-up switches. One set of switches allows users to define the limit of pitch change when the lever reaches its maximum deflection in either direction, up or down. This means that the player can be assured that when the arm is moved to its limit, it will be exactly at a specified pitch. As a result, the player can always use vibrato to get to a specified pitch change, regardless of their level of skill.

The pitch limits may be selected independently for 'up' pitch changes versus 'down' pitch changes. In a preferred form, a series of selectable pre-sets are provided which have maximum pitch changes in each direction that are relevant to particular styles of music. Of course, other implementations may provide other mechanisms to control this aspect.

For ease of operation, these user pitch pre-sets are grouped into two 'modes', A and B, selectable by a toggling footswitch on the control unit. This facilitates users changing the 'personality' of the whammy effect during performance. By way of example, Mode A could be a combination of small pitch changes, Mode B a combination of larger pitch changes.

It will be appreciated that in other implementations, different approaches could be used to control the pitch presets and other features, for example a PC interface, web interface, or app interface to a tablet, smartphone or other device.

After processing the data, the microprocessor sends its output to a simple circuit to convert its 5 v digital output to a 5 mA balanced current loop, the electrical protocol used in all MIDI devices, including the one used in this implementation.

The guitar audio signal is not connected to or through control box 30. The guitar audio only passes through the pitch change device 36, which is under the control of control box 30. Another footswitch on the control unit (not shown) sends a signal to instruct pitch change device 36 to go into bypass mode (where pitch processing is deactivated). The bypass and mode select switches have LED indicators to show users their current status.

It will be appreciated that the present implementation is self-contained and independent of the make/model of guitar or amplifier.

The sensing of the rotational position of the vibrato arm 20 is a critical aspect of the effective operation of any vibrato system. The ability of the artist to produce a full range of desired effects is dependent upon the accurate and precise determination of the rotational position of vibrato arm 20. We will now describe an aspect of the present invention concerned with sensing position using movement of a magnetic field using a Hall effect sensor. However, it will be appreciated that the present invention could be implemented using a different sensor system in conjunction with vibrato arm 20, or using such a sensor arrangement in conjunction with a differently constructed arm of other vibrato control arrangement.

Figure 3:
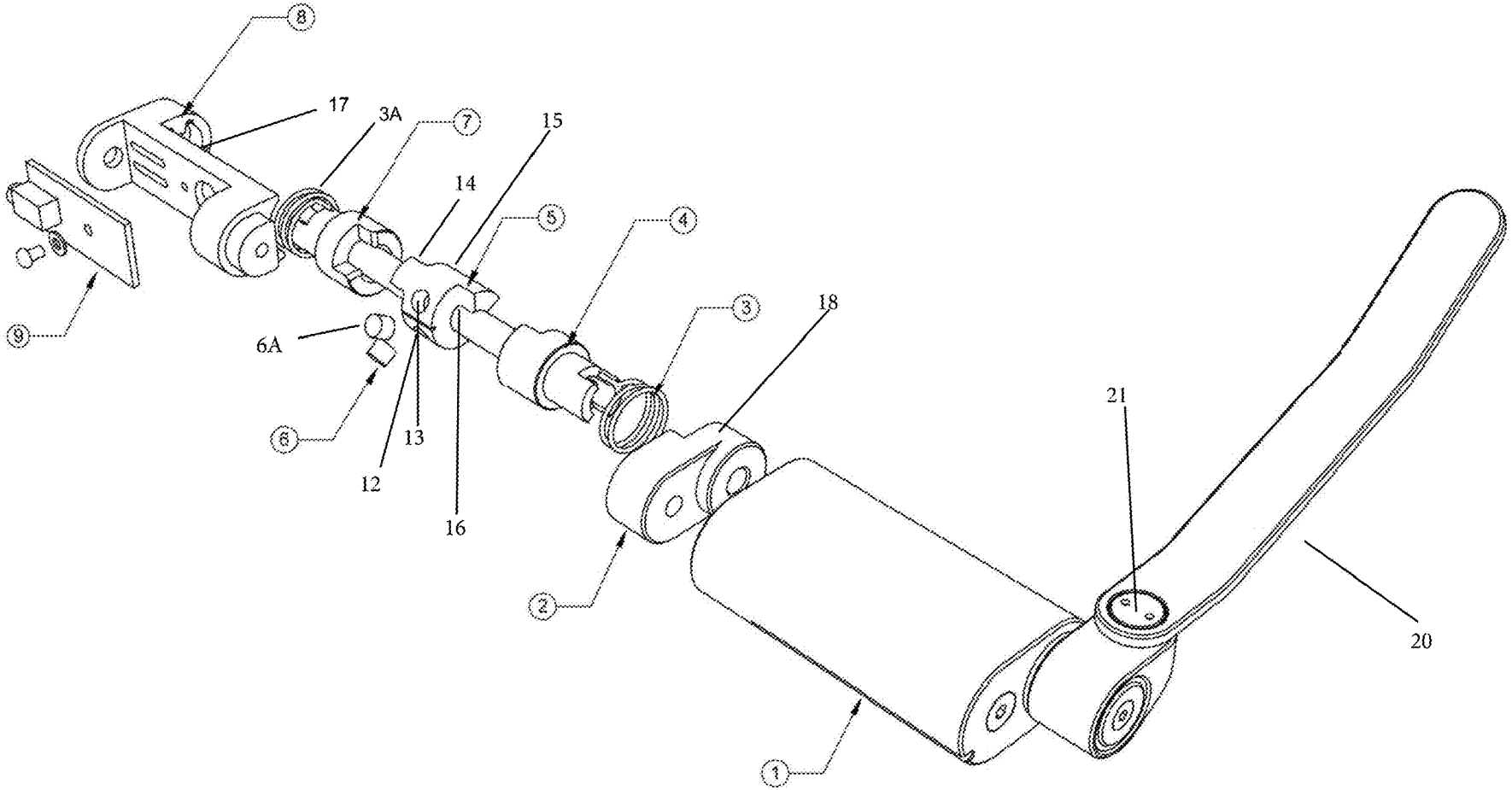
FIG. 3 illustrates in partly exploded view an implementation of a vibrato arm according to the present invention.

The Hall effect sensor is located on PCB 9 (see FIG. 3, 5). For this implementation, this must be a ratiometric Hall Effect device to produce a proportional output, not a binary 'yes/no' output common to some HE devices. A suitable example is the Allegro Micro A1302, which requires only a reference voltage (derived from the 5 Vdc power supplied), ground and output connection. The HE device output is a varying analog voltage proportional to the magnetic polarity and field strength.

The two magnets 6, 6A are preferably rare earth magnets of neodymium disc type of approximately 4000-5000 gauss field strength. These are commonly available. They are mounted with opposing fields and disposed at an offset, either side of the central datum on a spindle, in recesses 13, 12. Thus, a generally linear magnetic field is produced around them. The HE device is not visible, but is mounted on the front face of PCB 9, so as to face towards magnets 6, 6A. This is best seen from FIG. 5. As the spindle moves, the magnets move, and the field moves relative to the HE device, which therefore measures a variable magnetic field value and its changes in polarity, and hence produces a variable electrical output. Significantly, the HE device is detecting the combined flux field which establishes between the magnets which is essentially linear—rather than the absolute flux level (conventionally) detected from one magnet and its varying proximity to a HE device. The HE device output therefore represents the rotational position of the spindle (itself moved by the arm) in two rotational directions, about a central position.

The angle of displacement of the magnets on the shaft is directly related to the required degree of movement of the vibrato arm. They are arranged such that the arm movements/spindle rotation at their maxima provide sufficient field strength and polarity change to the HE device to ensure it attains its maximum and minimum voltage outputs. The distance between the rotating spindle and HE device is constant as it is fixed adjacent and tangential to the spindle.

The specified field strength of the magnets, combined with the displacement angle of the magnets and fixed spindle/sensor relationship previously described ensure the HE device produces full-scale output between the maximum arm positions: fully up and fully down. For user convenience, the full scale values are not used in practice as the processing constrains pitch changes to an operational zone which is less than the maximum arm displacement, as described elsewhere.

The corollary is that the processing only requires a sub-set of values from within the full range of data values available. This has the advantages of providing a good signal-to-noise ratio in the system and making the mechanism more tolerant of manufacturing and assembly tolerance drift, magnet field strength variation, HE device tolerance and the like. The sensing method described provides a contact-free, wear-free sensor system with linear output.

The PCB 9 derives its power and reference voltage from the control unit via a 3 conductor cable. This cable also carries the output voltage back to the microprocessor for A-to-D conversion, as described previously. Many DSP pitch change devices need to change mode in order to switch between changing pitch up, or pitch down. This is often because the algorithms of (high quality) pitch manipulation are specific to each direction of pitch change, up or down. Real-time pitch manipulation is a highly nuanced area of mathematics, using sophisticated processing. The preferred implementation of the present invention relies upon an off the shelf pitch change device, as discussed above. This commercial product is similar to many other pitch change devices in the musical instrument area—they do this changeover by giving the user a toggle or rotary switch to select the required function, pitch up or pitch down.

The control box 30 of the present implementation detects which "pitch-change direction" is required on the fly, by analysing the incoming data stream with reference to a nominal centre (zero-pitch) value. If it determines that the pitch change direction has changed, it sends the appropriate MIDI Program Change command to the DSP to set it to the required pitch mode, up or down.

Figure 8:
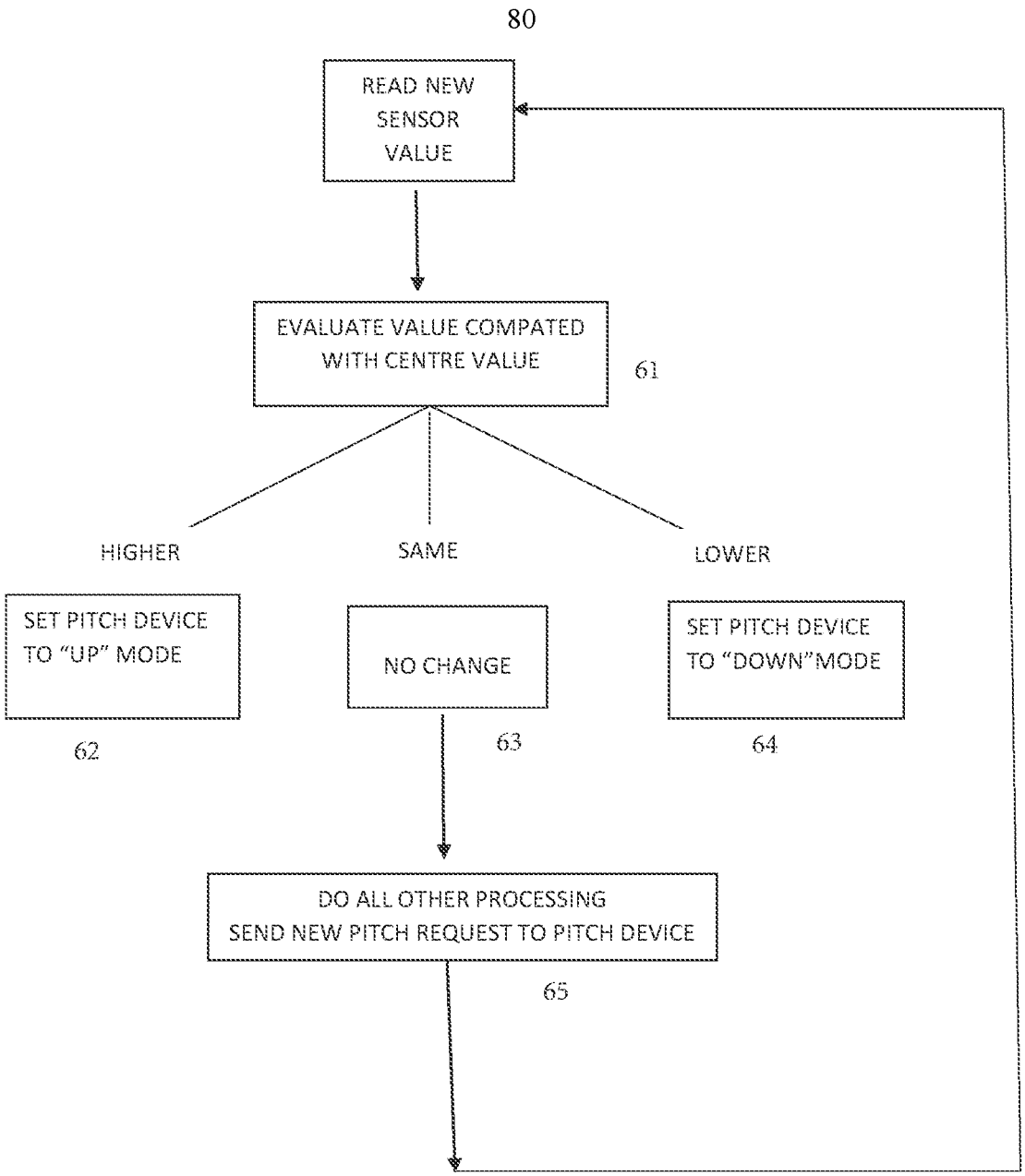
FIG. 8 is a flowchart illustrating pitch direction change.

FIG. 8 illustrates the software operation of this feature in the control box 30. Sensor data 60 is read. This value is evaluated relative to the centre, zero pitch value. If the arm is at the centre value (i.e. if the sensor data corresponds to the centre position), then, it sends a 0 pitch change command 63. If the value is higher, the pitch change is set to UP, at 62; if lower, it is set to down at 64. Other processing (as will be described below) is then completed, and a new pitch change request sent to the pitch change device 36.

Control box 30 does various data processing to provide user features and functionality as described elsewhere. Its final output in this implementation is scaled and mapped to meet the MIDI protocol requirement that Control Change commands are only legal between values of 0-127 as MIDI uses 7 bit representation of variables. Remapping and scaling is a trivial function and can be easily changed to meet the requirements of other pitch change DSPs.

Figure 14:
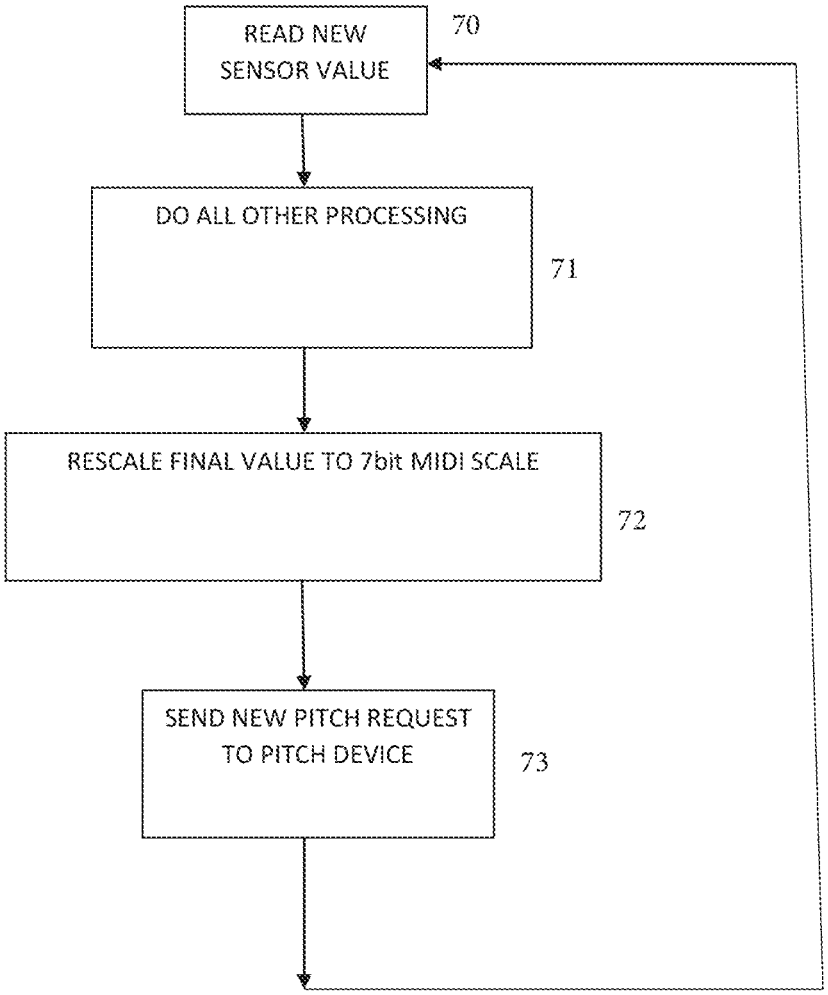
FIG. 14 is a flowchart illustrating rescaling to MIDI scale.

FIG. 14 illustrates a remapping process. Sensor values are read at 70, and the required processing for pitch changes, etc. is carried out at 71. At 72, the determined pitch change value is rescaled to the 7 bit MIDI scale. This request is then sent to the pitch change device 36 at 73.

In this implementation, vibrato device 10 is connected to the control box 30, which in turn is connected to the pitch change unit, and it in turn to the amplifier or other output set up. However, it will be appreciated that it would be possible to, say, incorporate the control box 30 into the pitch control unit, or to otherwise provide the functional components described by connecting them in a different topology or arrangement. For example, the functions of the control box could be integrated into a section of a connecting cord or dongle for the pitch change unit.

Further, while the device is described for convenience using conventional connection cords, it will be appreciated that any suitable means of connection or communication could be used, for example a wireless connection such as wifi, optical networks, or other protocol adequate for the data requirements.

Figure 4:
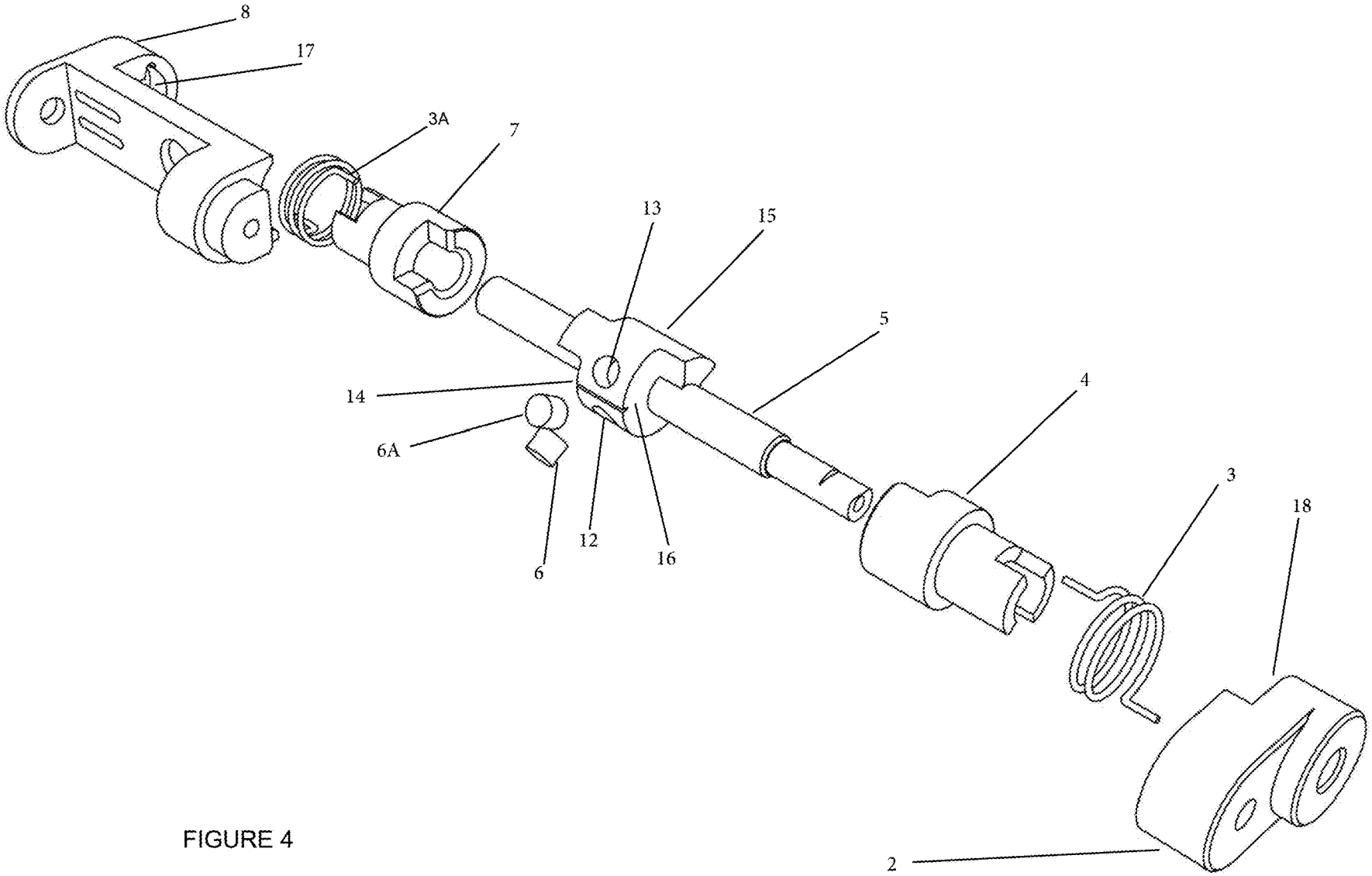
FIG. 4 shows a further exploded view of the arm of FIG. 3.
Figure 5:
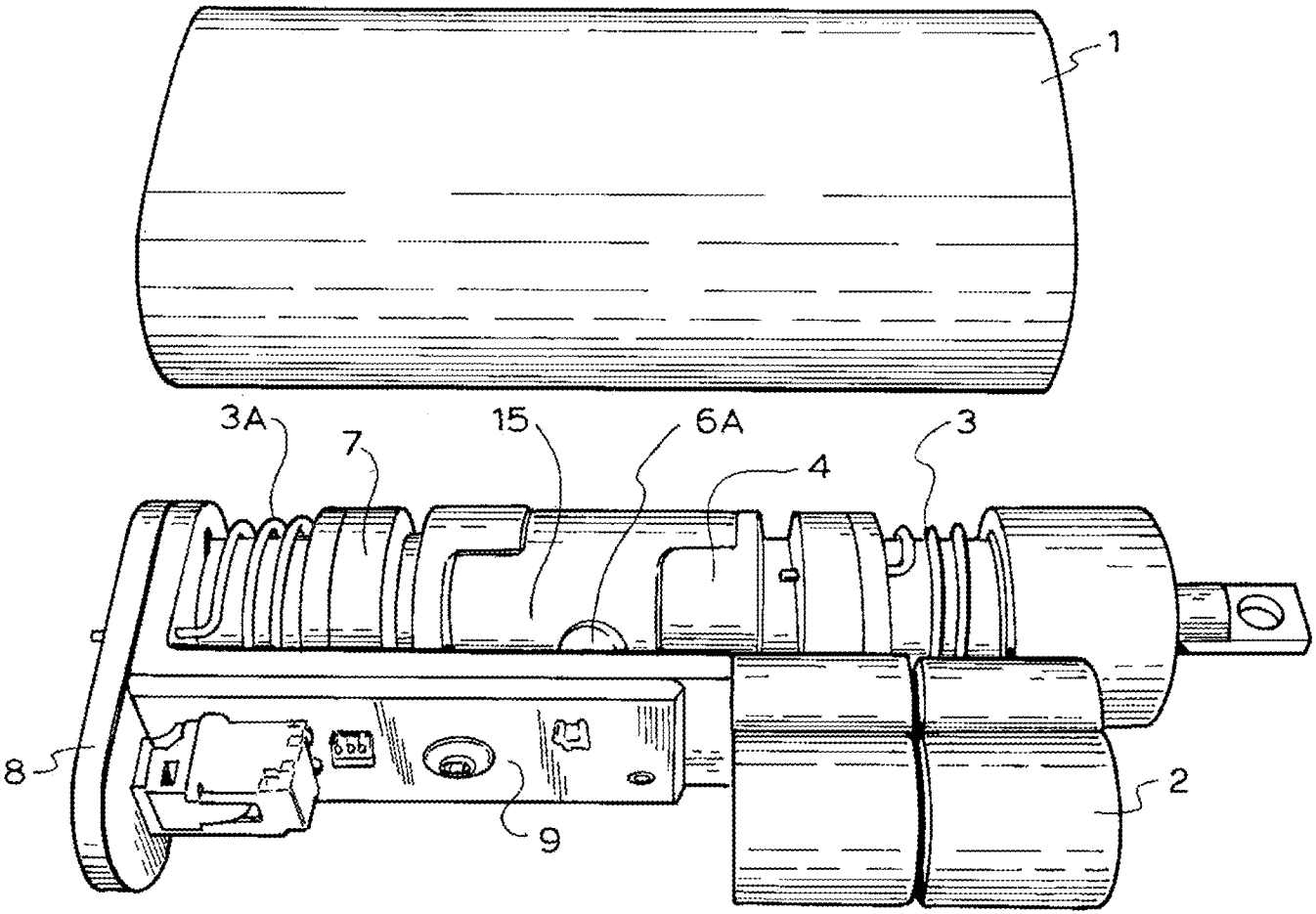
FIG. 5 shows a photograph of an assembled device similar to FIGS. 3 and 4.

FIG. 3 illustrates the mechanical operation of an implementation of a vibrato device according to the present invention. FIG. 4 illustrates the same implementation in greater expansion, and FIG. 5 is a photograph showing the assembled device according to this implementation with the cover removed.

The vibrato device 10 includes a spindle 5, extending through the length of device 10. Spindle 5 has a generally cylindrical shape, forming a shaft, with an enlarged, generally raised section 15 disposed near the longitudinal centre. This includes angled cams 14, 15 which will be described in more detail below. Raised section 15 also includes recesses 12, 13 for receiving magnets 6. Cover 1 is placed into position once the rest of the vibrato device 10 is assembled.

At each end of the spindle, collars 7, 4 are disposed. These are free to rotate about the spindle, but limited in their maximum rotation by respective end stops 17, 19 (indicated but not visible) in the housing 8 and end chassis 2 respectively. Each collar has an associated torsion spring 3, 3A. The springs are connected at one end to their respective collar 4, 7 and at the other to mounting recesses 8, 18. The springs and collars are connected so that they resiliently resist rotation. They are installed during manufacturing under a degree of tension even when the mechanism is in its centre position.

Arm 20 is attached to the end of spindle 5. Arm 20 includes a pivot 21 to allow the angle of the arm to be adjusted to suit the player.

When assembled, the whole mechanism sits largely within housing 8, with chassis support 2 at the same end as arm 20. It can be seen that PCB 9 and the associated sensor (not visible) sit beside the magnets 6, 6A in the assembled state, magnet 6 being visible in FIG. 5. This facilitates the operation of the Hall Effect sensor, which is described above.

The key mechanical requirement is that the arm 20 can be rotated smoothly to the desired position, and return to centre (RTC) with high reliability and accuracy. The centre is the point where there is no requested pitch change, and the guitar operates normally.

The shaping of the cam surfaces 14, 16 on spindle 5 is an important component of the operation of the RTC mechanism. The collars 4, 7 are co-axial and can rotate freely, but in opposite directions, when forced by the rotation of the spindle, transmitted by the spindle cams 14, 16. Collars meanwhile, are under tension from torsion springs 3, 3A. These springs have a three-fold function:

They provide resistance for the user to move the arm 'against', providing haptic feedback. They enforce an accurate centre position when the vibrato arm is at rest and they return the spindle to the neutral, zero-pitch-change position (with high accuracy and repeatability) when released.

The resistance function is accomplished because the springs resist the rotation of collars 4, 7. Each cam surface 14, 16 of the spindle is intimately contacting a surface of the corresponding collar 4, 7 (whether rotating clockwise or anticlockwise). The spindle therefore receives the same (bi-directional) rotational resistance as the collars.

Further, the shape of the cams 14, 16 provides an obstruction to prevent the collars 4, 7 rotating further than their respective neutral position. Positioning of these mechanical 'end-stops' can be accurately defined in manufacture so that both collets return to an invariant position.

The net effect is that the spindle 5 always returns to a fixed, neutral position with high precision and repeatability. The RTC process is not tolerance bound. The springs do not have to be perfectly matched (which is near impossible without being very costly) as the RTC factor is not reliant on that aspect. The springs are preferably "over-specified" so that they still maintain adequate torsional strength as they age.

Further, the pre-loading of the springs can be set in manufacturing to ensure it will overcome most hysteresis in the friction components inherent in any mechanical RTC mechanism.

It will be appreciated that the present invention may be implemented using any suitable materials. In order to allow for the operation of the Hall effect sensor arrangement, it is preferred that the materials are non-magnetic.

Illustratively, the shaft/spindle structure, arm and case are formed from machined aluminium. The collars are machined nylon. The chassis is formed from machined nylon composite. All the components may be suitably produced by CNC machining.

The express focus on the return-to-centre (RTC) mechanism of the vibrato system is to meet the requirement of very high accuracy because even small pitch errors are detectable at the centre (or 'null') position by listeners. Any tuning discrepancy is particularly evident relative to other instruments in the performance who are still at the correct reference pitch.

In performance, musicians first agree on a reference pitch to tune their instruments to. A pitch control device may be rendered unusable in performance if the instrument is made slightly out of tune with that reference pitch by virtue of any such RTC errors, even though the pitch control device is nominally not active (i.e. at its 'rest' position, supposedly sending 'zero-pitch-change' commands to the pitch processor).

There are several other rule-based/algorithmic functions within the embedded software, in the control box 30, which assist in the effective operation of the vibrato system.

At power-up, the control system uses the current value of rotational position to set the nominal centre value. This will account for small changes in the centre value due to wear, temperature, magnetic field strength changes etc. If a "nonsense" value is detected (i.e. outside defined limits) a centre value is retrieved from flash-eprom contained within the preferred processor. The initial centre value is measured/stored at the time of manufacture.

In mechanical vibrato systems, there is a certain degree of slop or free movement around the centre, which is generally related to the arm coupling. It would also not be desirable for the smallest rotation of the vibrato arm, for example merely due to moving or changing the position of the guitar, to cause a pitch change.

The degree of precision in any RTC mechanism is limited by the design, manufacturing tolerances, materials, wear, cost and so on. These determine the accuracy and repeatability of its RTC. A method to mitigate errors in RTC operation is a 'null' zone in the operating region, analogous to the 'slop' or tolerances within a mechanical systems The sensor method produces a range of values based on the position of vibrato arm 20, and its centre value (the 'rest' position) will have been determined at manufacturing or by calibration. It is a simple matter in the data processing software to allow a tolerance window (or null zone) so that the centre position is effectively not a single value, but a range of values around the actual centre value.

According to the present implementation, a 'null zone' is computed in each direction (up or down) from the centre position of the vibrato arm 20. Hence, the null zone bi-directionally covers a specified offset from the centre value. When the values read from the sensor lie within the null zone, no pitch change is effected because the control unit sends a zero pitch change value to the pitch unit. This stops the arm from being too sensitive to (unintentional) user manipulation—even gravity!—as well as easing the absolute accuracy required in the RTC mechanism. It does so without compromising the high resolution available in operational areas outside the null zone. In a preferred implementation, the size of the null zone is programmable. It is further useful as it defines part of the working area without ambiguity. It is highly repeatable, and therefore a learnable aspect for the user.

Figure 6:
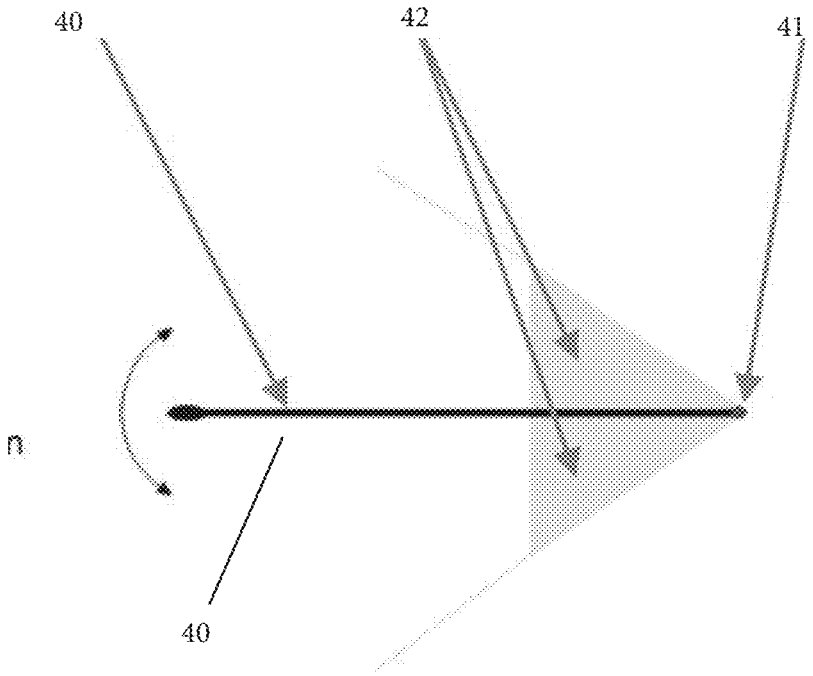
FIG. 6 is a schematic illustration of the null zone in the operation of an illustrative arm.

This is depicted in FIG. 6. This schematically shows a vibrato arm 40 and its movement/rotation around a pivot point 41. The null zone is illustrated as shaded areas 42. For clarity, the size of the null zone is exaggerated. In a practical implementation, a typical range for the null zone may be +/−2 degrees. Of course, it will be appreciated that this is a matter of design choice in a particular implementation. Arm movements within this zone do not produce pitch change requests to the pitch processor. Instead, the control box 30 software sends pitch requests of zero, generating no pitch change and ensuring the instrument is at its reference pitch.

Figure 9:
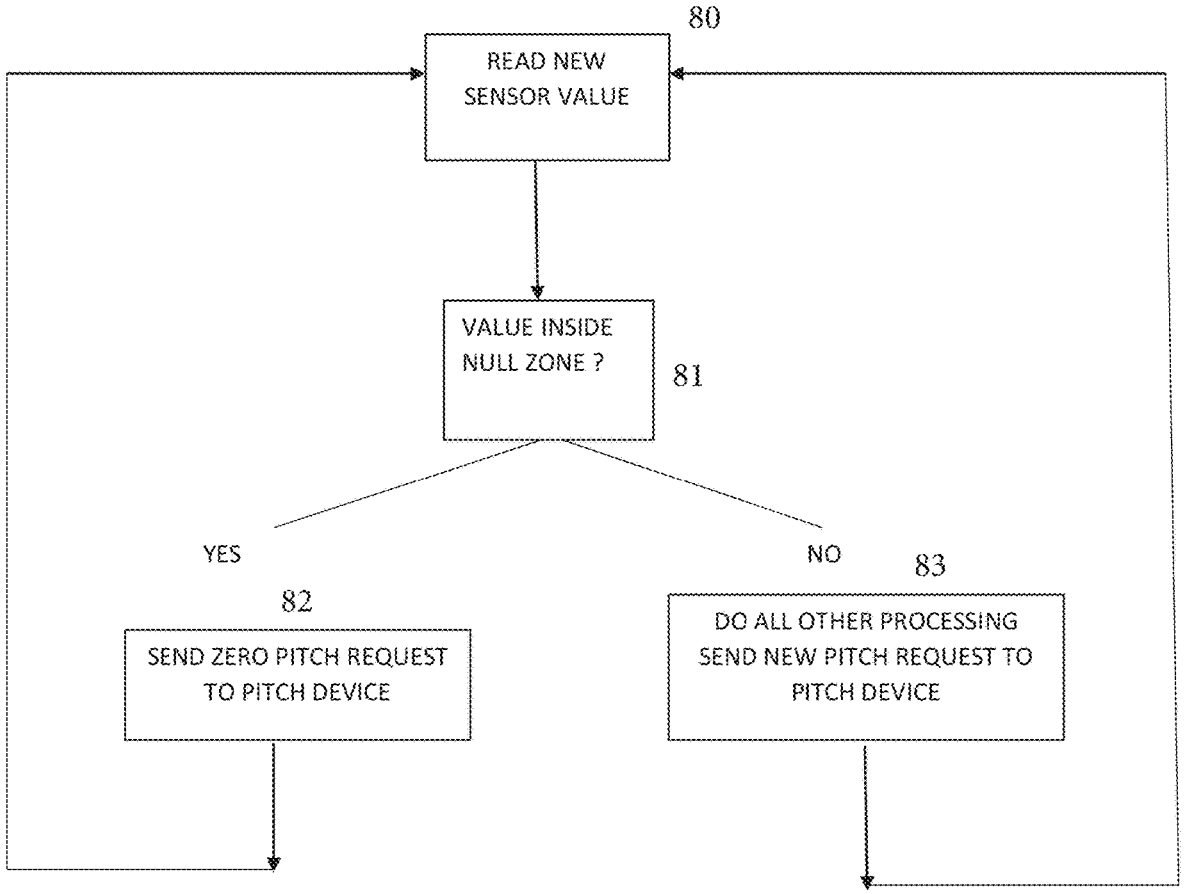
FIG. 9 is a flowchart illustrating null zone detection.

FIG. 9 illustrates the software control of this process. The sensor value is read at 80. If the value is determined at 81 to be inside the null zone parameters, then a zero pitch request is sent to pitch change device 36. That is, the arm is determined to be within the predetermined null zone. In all other cases, the arm position is processed as normal, at 83.

The addition of a null zone reduces the degree of absolute accuracy required of the mechanism's RTC method. This relieves some of the burden, hence cost and complexity, imposed on the mechanism. It also stops any jitter from the sensor system being translated to undesirable small pitch variations by the subsequent pitch processor. Further, it gives the user a small physical region (of rotation of the arm) which is inactive. This is desirable in practice as it (a) makes inadvertent operation less likely and (b) reinforces the haptic feedback when users are trying to return to centre.

The existence of a null zone does, however, change the linearity of response to movement of the vibrato arm. Users must move the arm out of the null zone before any pitch change begins. If that null zone is too large, users will have difficulty performing sensitive 'waggles' around the centre position—a common vibrato technique in performance. As a result, there is an inherent conflict between the size of the null zone preferred for say, manufacturing economy (larger) versus the 'feel' of the device to the user (smaller).

Even a sophisticated mechanism that is designed to enforce a fixed centre position will have an underlying issue which cannot be eliminated completely: stiction. This is a form of static friction, common among objects in contact. It can stop vibrato arm 20 from returning precisely to the centre position with the degree of precision that is ideally required.

Under certain conditions, the force of the return springs may not completely overcome the stiction which will emerge when the arm is very close to its rest position. Stiction has several causes: electrostatic and/or Van der Waals forces and hydrogen bonding among them, as is known to those in the art. Under vigorous manipulation of the arm this issue will likely not emerge (due in part to the added momentum of the arm generated by the spring return forces). However it is possible that a slow, gentle movement of the arm by the performer when returning to centre may allow it to reach a point of stiction when very close to the centre position. The point at which stiction occurs will be where the dynamic force of the spring return method is balanced by the forces of stiction. These forces are very small, so the attendant error in returning to centre is also small, but not negligible. This will produce an undesirable pitch error, as described earlier.

The size of the null zone is constrained by two competing considerations. A larger null zone allows for easier manufacturing, but a smaller null zone provides better linearity for the player. A second strategy is employed to eliminate both these null zone contradictions, and eliminate minor errors resulting from stiction, wear etc.

This strategy will be referred to as Twilight Zone (TZ) processing. A small null zone is defined (say, +/−0.5 degrees) and applied to the data from the sensor. This provides a limited version of the benefits previously described—freedom from jitter in the 'at rest' data and some lowering of the required tolerance in the RTC mechanism. By itself though, this null zone is defined to be so small that it may not accommodate errors like stiction, or allow for drift, wear or variations caused by temperature, gravity etc.

Two other zones are established in the data which are adjacent but outside the borders of the null zone. The combined area of these zones can be arbitrarily large. They may, for example, be contingent on the inaccuracy or lack of repeatability of the RTC mechanics. These zones, nominally symmetric around the null zone, are labelled the Twilight Zones (TZ). These are depicted in FIG. 7, with the TZ expanded for clarity.

Figure 7:
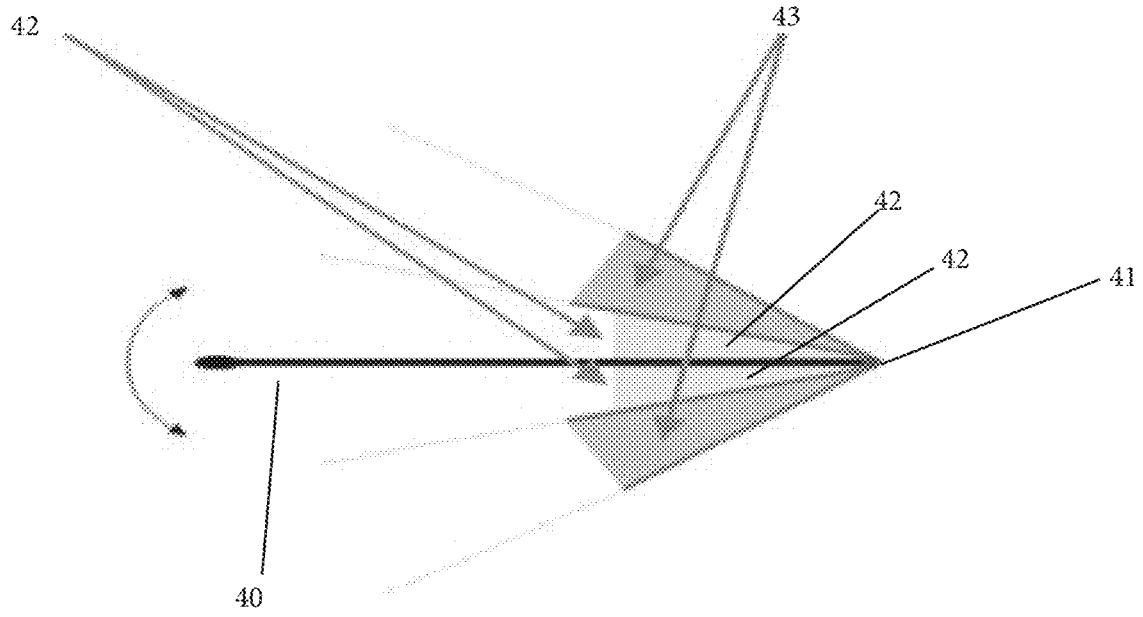
FIG. 7 is a schematic illustration of the null zone and the fringe zone in the operation of an illustrative arm.

FIG. 7 shows the null zones 42 around the 'true' centre position of the vibrato arm 40. In addition, TZ 43 is defined on each side of the null zones.

Software routines in the control box 30 constantly examine the sensor values to see if they fall within the TZ. Temporal history and heuristics are applied in this routine to determine if the TZ values are being elicited by the user, or are a product of an error like stiction, wear etc.

The important factor to discern during TZ processing is whether the values from the sensor are the result of mechanical 'error' (e.g. caused by stiction) or a musical choice by the player. It is significant that these are very 'small-magnitude' errors in absolute terms around the 'at rest' value. However, in terms of the instrument being 'in tune' (in the 'at rest' position of the vibrato device) with other players in a performance, small-magnitude errors are much more musically significant than the absolute values would suggest.

In musical terms, small variations from absolute pitch in the rest position are rarely chosen as part of a performance. When used musically, small variations such as this are invariably small-scale vibrato i.e. small periodic changes in pitch around a reference pitch. TZ processing accordingly to this implementation is intended to differentiate between static errors and deliberate periodic changes.

When a sensor value falls within the TZ zone, two critical factors are analysed: (1) is the value constant (taking account for sampling jitter), or varying?(2) if the value is constant, is it persistent for a time period longer than musically 'sensible'?

If both analyses concur (constant value, persistent over a period) the value it is determined to be the result of a TZ error. The appropriate time period (for the TZ counter period) is partly subjective, partly empirical and partly determined by inference e.g. very little music would have slowly altering, very small pitch changes. Most popular 'western' music does not.

Rules of thumb (heuristics) are applied to make the determination for an appropriate TZ counter period. For example, it is unlikely that a small, static pitch value around the 'at rest' pitch would persist for a few seconds. However, it is possible that a small, static pitch value around the 'at rest' pitch would persist for milliseconds. The latter may be an artistic choice, or merely a lapse in performer manipulation of the arm. Precise values can be determined for a particular implementation by a process of trial and error, as well as subjective preference, but are likely to be in the range of 0.05 to 1.0 seconds.

When it is determined by the analysis routine that an error is occurring, the software routine re-maps the original centre value (determined at manufacture or by calibration) to a new, computed value. This value resets the centre datum to a new value, and hence new, Null zone and TZ values are set around the new datum. The centre value, in effect, is not a fixed point, nor a pre-ordained value or band of values, but a dynamically varying 'sliding band' of values.

TZ processing is enhanced (i.e. made less obtrusive) in operation by the use of techniques like successive approximation in correcting the error. This overcomes the step-change in pitch that would be apparent to the user if a (relatively) large correction was immediately applied. Instead, the routine makes a smaller change (e.g. an average of the difference between the previous centre value and the current (error-created) centre value). Because the whole error analysis process is happening very quickly (compared to human perception), multiple small corrections (e.g. successive approximations) can be performed which are transparent to the user. In practice, this makes even (relatively) large corrections feasible.

Figure 10:
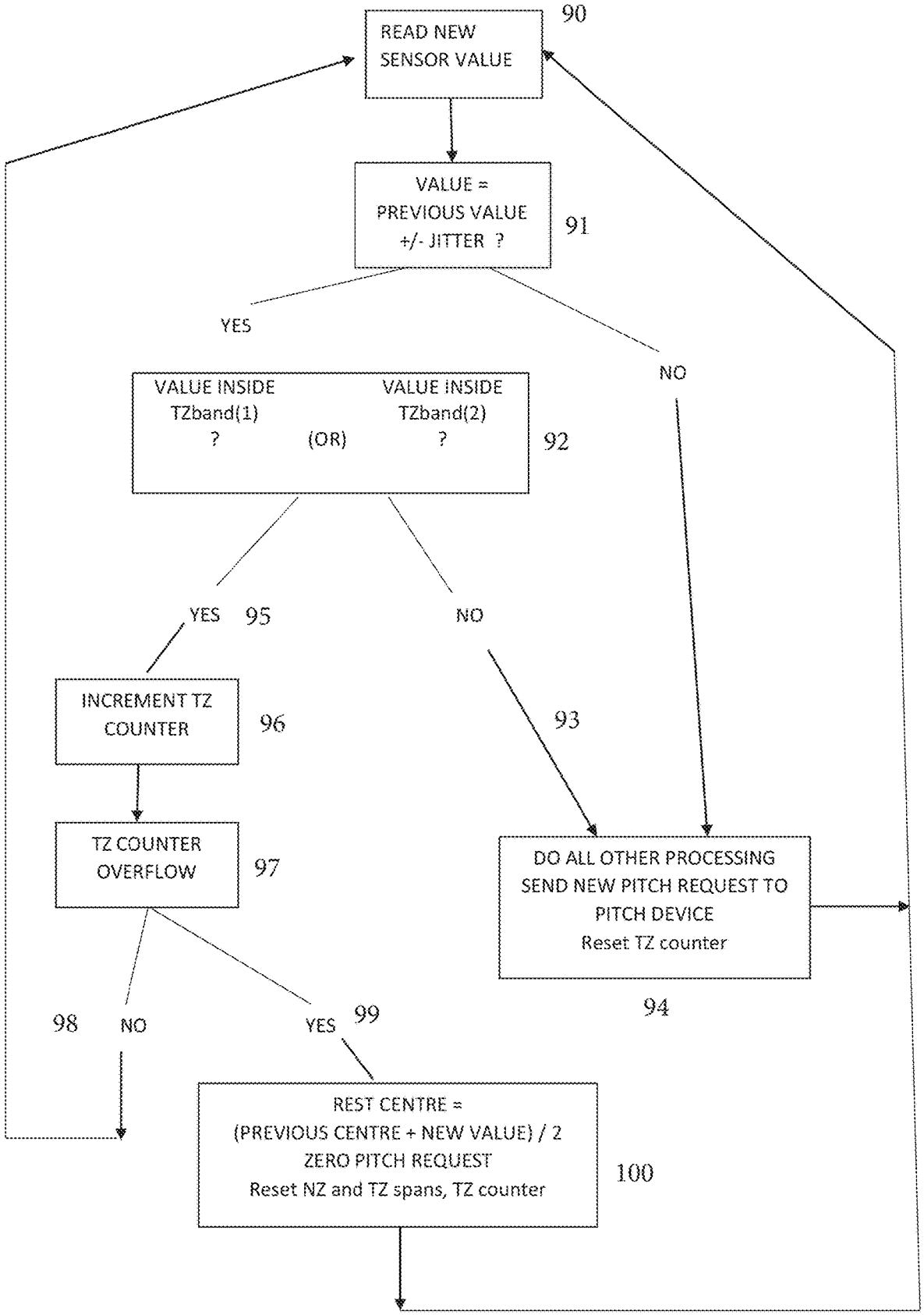
FIG. 10 is a flowchart illustrating TZ zone processing.

FIG. 10 provides a flowchart illustrating an implementation of TZ processing. At 90, new sensor value is read. If it is equal to the previous value, plus or minus a small amount of jitter (a preset value), then the Z process commenced at 92. If not, this is an active movement of the arm, and the process proceeds as usual at 94.

At 92, it is determined whether the value is inside one of the TZ bands. If not, at 93 the value is passed for normal processing at 94. If it is, then at 94 the value is passed to the TZ counter, and the counter is incremented at 96. This is then passed to 97, where it is determined whether the TZ counter has overflowed. If no, then at 98 at process returns to the top for a new sensor value at 90.

If the value is yes at 99, then this is passed to process 100. The centre value is reset, to a value equal to the old centre value plus the new centre value, divided by 2. A zero pitch change request is sent, and the Null Zone and TZ parameters are reset in line with the new centre value. The TZ counter is reset, ready for the next cycle.

The benefits of Twilight Zone processing are many: At the rest position, the vibrato mechanism is constantly and transparently being corrected to zero pitch change (i.e. the instrument stays perfectly in tune with its reference pitch because the pitch processor is not inadvertently putting it out of tune)

TZ processing also provides the user benefit of maximum linearity of response and sensitivity in operation by minimising the size of the null zone.

TZ processing also means the RTC mechanism can be less sophisticated while still providing acceptable performance, and if desired, the manufacturing tolerances can lowered while still providing an acceptable outcome. This in turn may allow for lower cost materials and assembly processes to be used.

Further, various factors like wear, orientation relative to gravity, temperature, movement during performance and the like are constantly corrected without user intervention (i.e. re-calibration), and this is continued without intervention by the player for the life of the device.

A third strategy employed in the present implementation of the invention is nonlinearity in the scaling algorithms to match user expectations of what 'feels' natural or intuitive when moving the arm to generate pitch changes. Small pitch change requests around the centre position and near maximum and minimum arm deflection are rescaled to allow for finer control by the user. This makes the vibrato effect easier to control (in a musical sense) when users are 'homing in' on (musically) important targets . . . viz approaching zero pitch and max/min pitch change. This nonlinearity in the scaling is particularly advantageous when the control unit is set up to make large pitch changes at max/min arm deflection.

Figure 11:
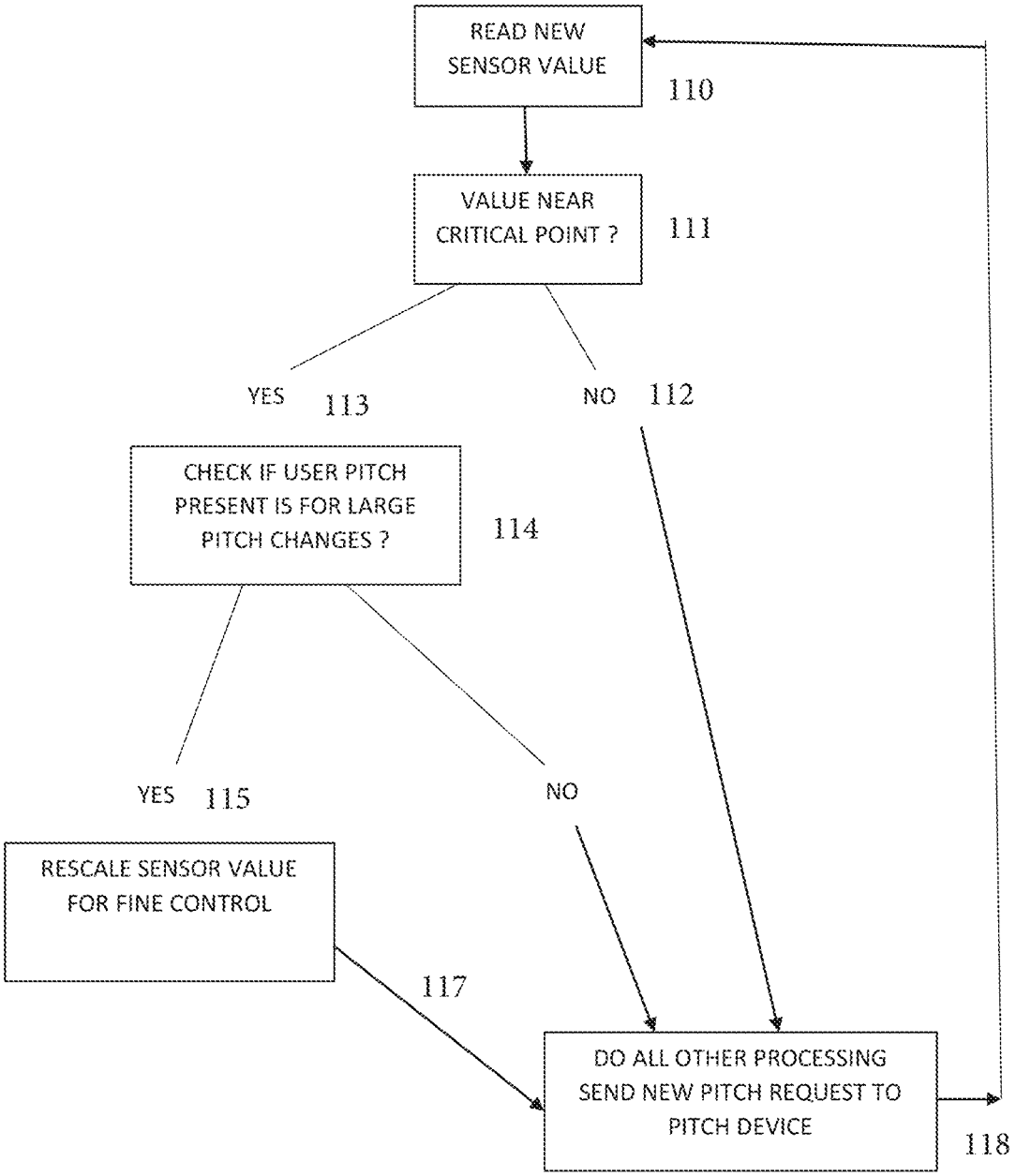
FIG. 11 is a flowchart illustrating re-scaling of pitch control.

FIG. 11 illustrates a process for implementing this feature. At 100, a new sensor value is read. At 111, it is determined whether the value is near the critical point. If not, then at 112 the process moves to normal processing at 118. If yes, then at 113 the process 114 checks it the user pitch preset is for large pitch changes. If no, then at 116 the process moves to normal processing at 118. If yes, then at 115 the process 117 rescales the sensor value to provide fine control (as discussed above). The re-scaled value is then passed to normal processing an pitch control at 118.

A fourth processing strategy contributes to ease of use: pitch changes limits.

Pitch change "limits" are derived from user switch settings and implemented by the firmware. These are, in effect, user pitch presets. In practice, when the user moves the arm by a defined amount (say, 80% of its possible travel) the pitch change is frozen at a value determined by user switch setting/pitch preset, irrespective of further arm movement in the same direction. This has a powerful application: the frozen value (or "limit") is pre-determined (hence, known) and guaranteed to be musically in tune with the normal musical scale. This requires no user skill; it is an inherent function of the firmware. Musically appropriate limits can be set by the user for both directions (up and down) using (say) DIP switches attached to the processor, and in the present invention there are two 'modes' of operation, A and B, each with selected pitch limits.

Figure 12:
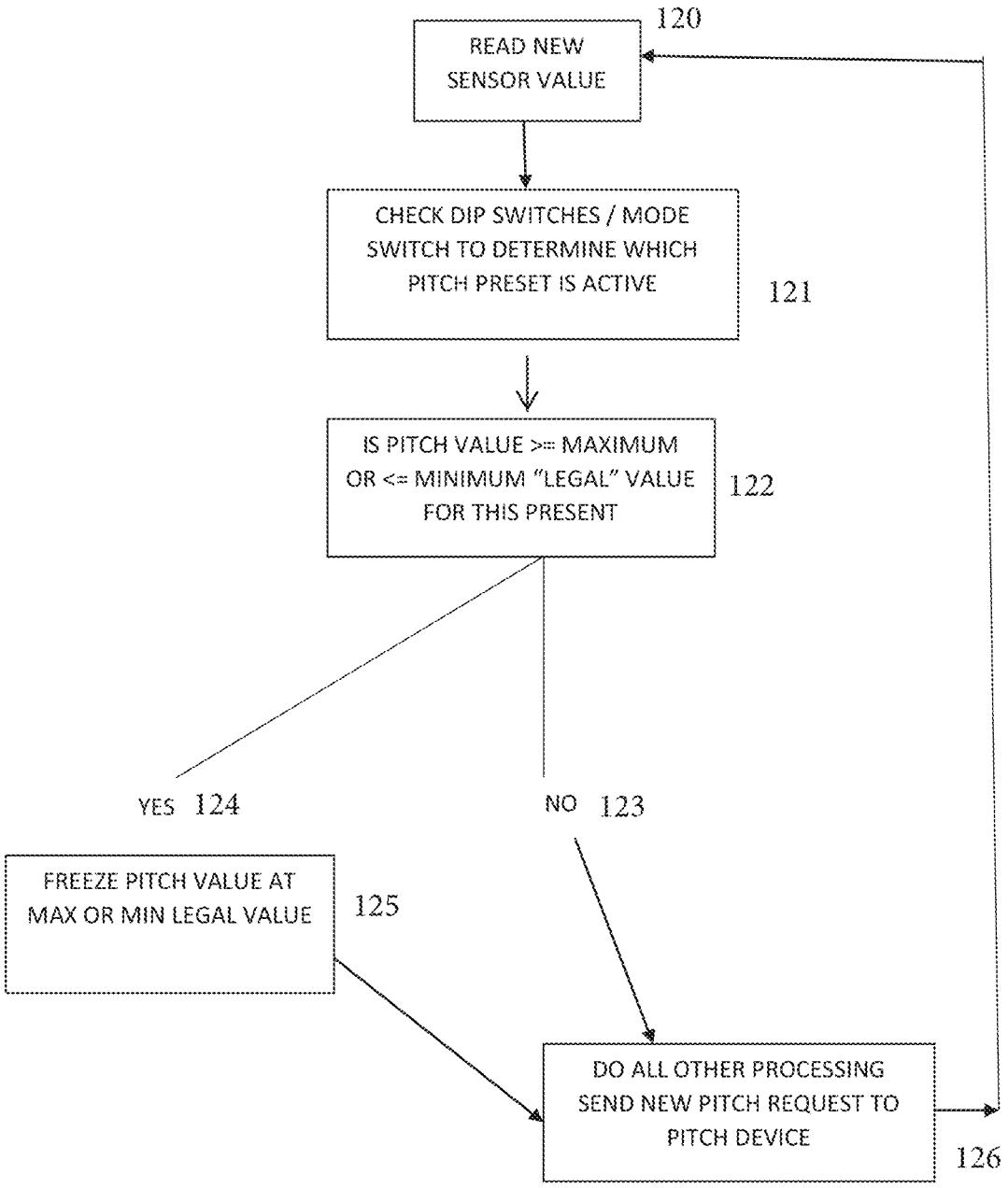
FIG. 12 is a flowchart illustrating control of maximum and minimum pitch changes.

FIG. 12 illustrates the pitch preset process in one implementation. The sensor value is read at 120, and at 121 the software checks the status of DIP switches (or whatever other control mechanism is used) and mode to determine which pitch preset is active. At 122, it is determined whether the pitch value corresponding to the sensor value is greater than the maximum permitted or legal value in that mode. If not, then at 123 the processing continues as normal at 126. If it is greater, then at 124 the process 125 freezes the pitch change at the maximum/minimum permitted value for that mode. This then proceeds to normal processing and request for a new pitch value at 126.

According to the present implementation, the modes of operation are footswitch selectable: Mode A is nominally a Bigsby/Strat-styled emulation and Mode B is nominally a Floyd Rose emulation. These modes will be familiar to most guitar players. Users can instantly change modes to match the musical performance. LEDs provide feedback of the current mode selection. However, it will be appreciated that more or less modes could be provided, and controlled in any suitable way.

A fifth processing enhancement according to this implementation of the present invention is arc-mapping. All pitch changes can be scaled over any sized segment of the arc of rotation of the vibrato arm. For example, a small pitch change of (say) +/−one semitone can be mapped to the whole segment of arc (for very fine control) or a smaller arc (for normal control). In the present invention each pitch preset is mapped to a preferred span of arc to provide users with an intuitive zone of operation. This arc-span mapping is part of the firmware processing and transparent to the user. Arc-mapping has another useful attribute apart from intuitive operation: to suit the physical layout of specific instruments it may be desirable to obtain (say) maximum pitch down with the arm only rotated to 70% of its maximum travel. In the present implementation, each pitch preset has a unique travel range in each direction.

Figure 13:
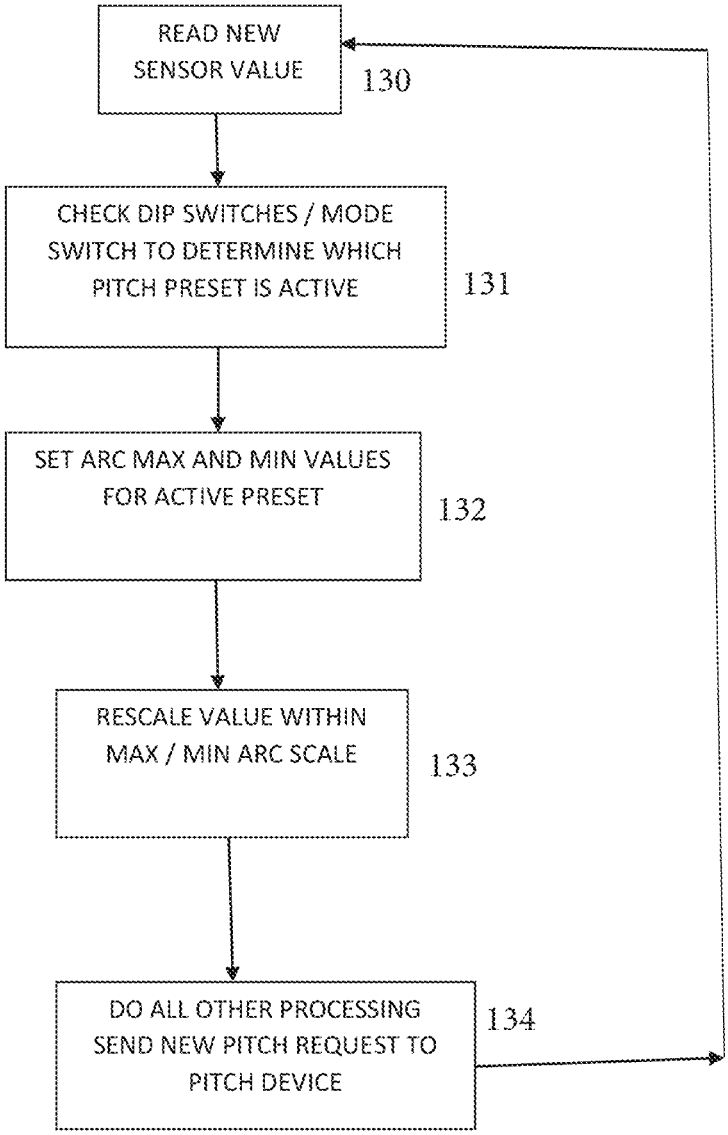
FIG. 13 is a flowchart illustrating control of arc rescaling.

FIG. 13 illustrates an implementation of the arc mapping process. At 130 the sensor value is read, and at 131 it is determined which control switches and mode are active. From this preset, at 132 the maximum and minimum arc are determined (e.g. from a look up table). The sensor value is then rescaled at 133 to have a value within the predefined arc scale for that pitch preset. The value is then sent for normal processing at 134.

The firmware has another mapping process (which follows the arc mapping) to rescale the raw sensor data to the smaller data set required by MIDI 7 bit resolution. As there is an abundance of resolution from the sensor, a working operational range can be used from within its larger data set—and some is even discarded e.g. at the max. and min. limits. This contributes to a better manufacturing tolerance: not every sensor has to be perfect. The system according to the implementation described only requires a smaller data set from within a larger, linear, data set. This is advantageous in practice.

Figure 15:
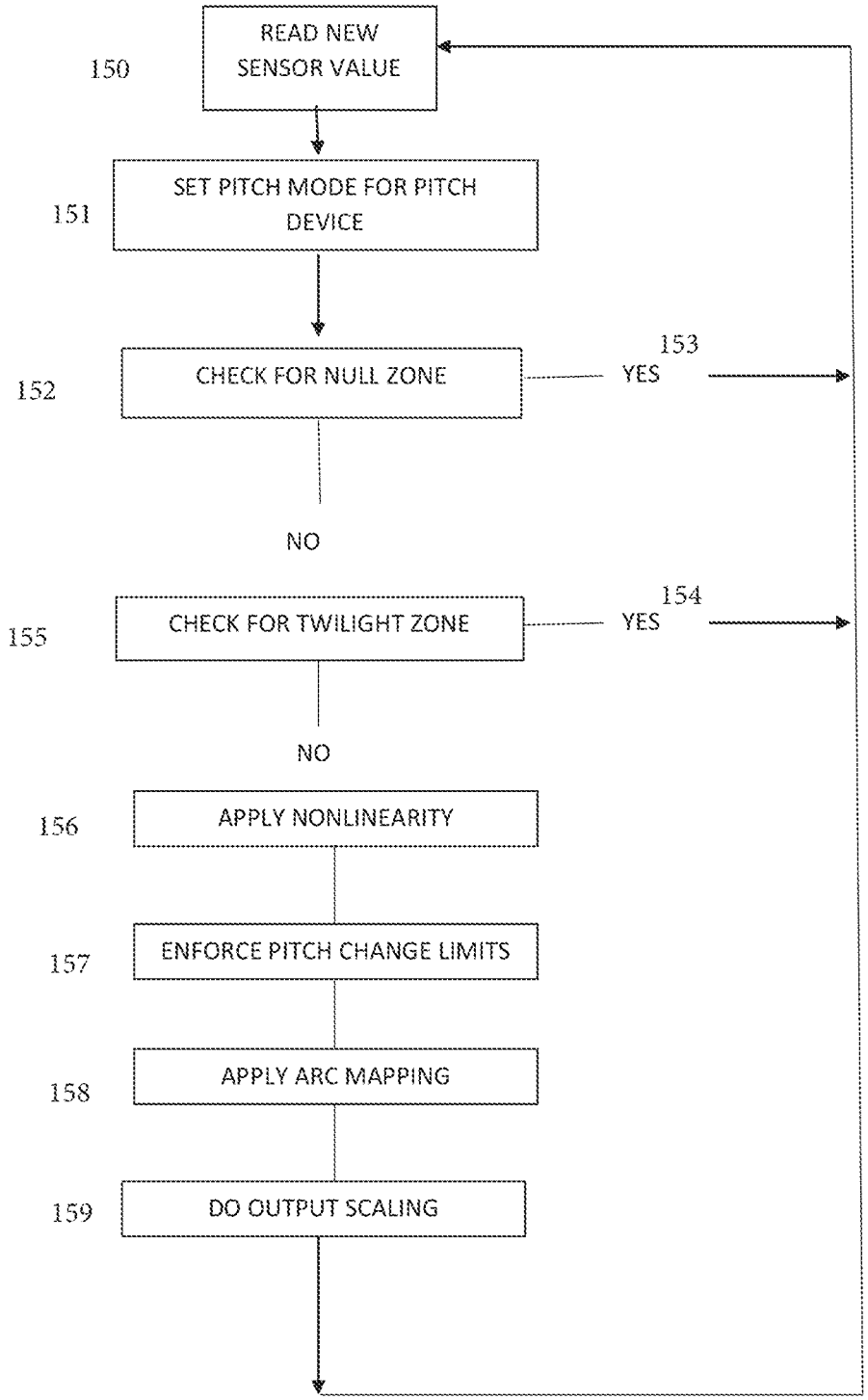
FIG. 15 is a flowchart illustrating the overall processing control for an implementation of the invention.

FIG. 15 provides an overview flowchart of the various sensing an pitch related processes, and how they are interrelated. At 150, the new sensor value is read, and at 151 the pitch mode is set, based upon the selections of mode and input controls made by the player.

Next, the null zone process 152 determines if the value is in the null zone, and if so, the process reverts to read a new value. Similarly, the TZ process operates at 155, and if the value is within the TZ, the process reverts to read a new value at 150.

If the TZ and Null Zone are not applicable, then the value has any applicable non-linearity applied at 156, and pitch change limits are checked at 157. Arc mapping is then applied at 158, the output scaled at 159, and a pitch change request sent.

It is noted that the implementation described is only one specific implementation, and that other implementations, for example using different mechanical systems could be used in conjunction with the electronic and software aspects of the developed methods.

The degree of movement of the arm need not have a fixed relationship to the degree of pitch change, unlike mechanical vibrato methods.

The extent of pitch change can greatly exceed what is possible with a physical system—for example, it isn't possible to use a mechanical whammy bar to produce an upward pitch shift of an octave (12 semitones). The increase in tension of the strings required for this amount of pitch shift would likely break the strings well before an octave shift could be achieved.

Virtualisation of a vibrato system (which is what the processing according to the present implementation is doing) can provide functionality that was not previously possible or experienced with a mechanical vibrato system. A well-known issue with virtualised devices is that people may already be acclimated to the physical system that they are replacing. It is therefore desirable that the virtual operational characteristics match human cognitive expectations—the virtual device must perform in ways that humans can relate to, predict, anticipate etc. This is especially true in the sensitive control of pitch to enhance musical expression.

A complication in this requirement is that human perceptions often diverge markedly from the actuality of what is happening in the real world. A simple example is evident in the human visual system: the eye is constantly moving (a form of jitter) to refresh the 'data' presented to the retina. This movement is small, but well within the acuity of human perception. Yet, it is totally masked by the visual processing of the brain and hence invisible to us all.

The preferred implementation includes software implemented strategies (for example nonlinearity and arc-mapping) to alter the response to user whammy movements, which in turn enhances the adaption to, and 'feel' of, various operations. This contributes materially to the ease of use of the device, especially when doing pitch manipulations for which there is no physical precedent. The strategies enhances the illusion that the virtual device is doing what you expect it to do, not the actuality of what you are doing.

Take the case of a large pitch shift range on the virtual whammy device—say, one octave up and two octaves down. This is a total of three octaves of pitch change —which would be impossible on a physical system. That degree of pitch change will be have to be spread across an arm movement/rotation of say, 25 degrees up and down. Simple calculations show that even a small movement of the arm should produce a significant pitch shift.

This is obvious, but not necessarily desirable. For example, a common function of the whammy is the "waggle". This is a small, periodic, pitch change around the mean pitch. It is the most common type of vibrato heard on any instrument, including the human voice.

When such large pitch changes are mapped to the limited movement of the arm (in this example +/−25 degrees) it becomes much harder to achieve a satisfactory waggle. It is difficult not to move the arm too much (especially in the heat of the moment) which makes the pitch change too large for a characteristic waggle.

According to the present implementation, software routines resolve this issue with non-linear translations of the arm movements versus the pitch commands which are sent to the pitch processor. Instead of a linear translation of what is being requested by the user's whammy manipulations, software processing provides variations in translation (altered 'transfer functions' to those in the art) to provide more 'intuitive' response. An example from the previous scenario (large pitch changes) illustrates this aspect. For musical reasons, the waggle is usually performed at the end (or decay) of a phrase or note. Usually, this will be when the phrase or note has either reached its maximum pitch change (e.g. an octave up) or no pitch change (i.e. the arm has returned to centre).

It is therefore desirable to 'de-sensitise' the arm when near either position—maximum pitch change, or zero pitch change. This is done by re-mapping the sensor data in accordance with various sensitivity curves, each of which is specific to the maximum pitch change setting and/or pitch change direction, up or down.

By having a specific sensitivity curve for each pitch change setting, the illusion of 'intuitive' response is greatly enhanced. Software according to the described implementation transparently alters the linearity of its response, thus matching the user's actions to their innate expectations.

The present invention further provides selectable operational modes that effectively emulate the most successful mechanical variants at the flick of a switch (e.g. Bigsby, Stratocaster, Floyd Rose).

These well-known mechanical forebears have characteristic pitch change capabilities, familiar to those in the guitar world. Identical pitch change settings matching all these products can be set up on the control box 30 (via the user-adjusted input switches previously described). The present implementation is therefore emulating the characteristics of these earlier products and can switch on the fly between emulations using the Mode footswitch.

The present implementation produces pitch change data from its sensor/processing. In this implementation the data is output in MIDI format. It is possible to use that data in other scenarios apart from live performance. One such is music recording. It is already common for keyboard/synthesiser players to record not just the audio of their performance, but also the MIDI data which their performance generates. This data represents aspects such as the note (i.e. pitch) played, its velocity and sustain and so on. By sending this data into another MIDI-capable synthesiser, different tonalities or instrument sounds can be produced but with the exact musical characteristics of the original performance. MIDI data recording is already a common feature of most recording software.

This provides flexibility and a level of convenience. Take the example where a great performance is recorded but is unusable because of a small mistake. It is often impossible to fix that mistake in the audio track (by editing etc.) without it being audibly obvious. If the MIDI data of that performance was also recorded, the data can be corrected, removing the mistake. It can now be fed to the original instrument which recreates the original performance. This can be re-recorded, now blemish free.

The concept of data recording can also be applied to the pitch data produced by the present implementation and can be applied in similar ways, for example: during a recording the MIDI pitch data is captured as well as the non-pitch-altered guitar sound. This is quite straightforward in most recording scenarios, as is known to those in the art.

At a later date, the musician can correct any vibrato 'mistakes' by altering/editing the MIDI data or re-recording any segment of the data. The audio of the original performance is not affected or altered in any way, only the data driving the pitch change device. Hence the process is non-destructive and can be rehearsed any number of times without danger of losing the original performance.

Other possibilities are presented: a musical phrase which didn't have a vibrato manipulation can have that modification added after the recording—again without losing the original performance.

Further, vibrato manipulations which were physically impossible during performance can be added later, when the player is freed from the task of playing the instrument.

It will be appreciated that the present invention includes various specific aspects, including mechanical, electronic and software implemented aspects. The present invention encompasses these in isolation, as well are in various combinations of one or more of the mechanical, electronic or software aspects.

The mechanical system described in relation to FIGS. 3, 4 and 5 could also be used to control a purely mechanical vibrato arm. In this case, the magnets, sensors and PCB would not be required. However, the components would need to be made more robust, and the torsion springs would need to have much larger resilience in order to provide the necessary mechanical force. However, the principle of the accurate RTC functioning would still be applicable.

Figure 17:
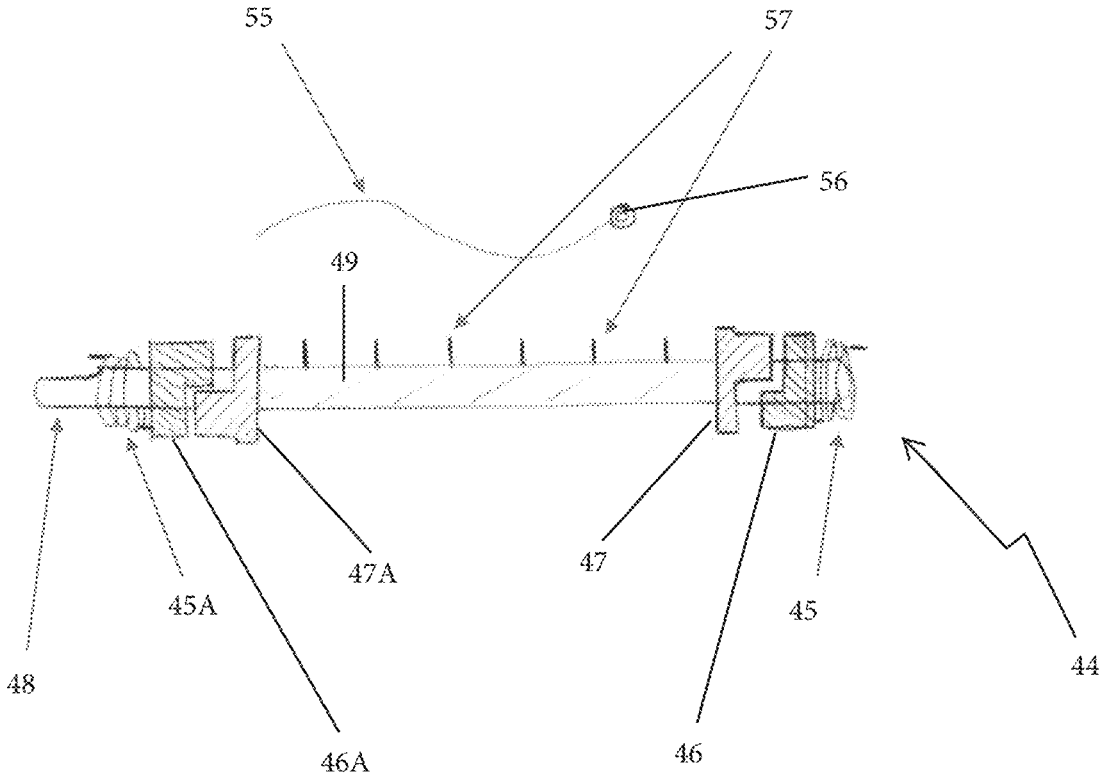
FIG. 17 is side view, partly in section, of a mechanical vibrato alternative implementation.

An implementation of such a mechanical implementation is shown in FIG. 17. Spindle 49 extends through the centre of the device, with arm mounting point 48 at one end. In comparison to the other implementation described, the cams 47, 47A are split, with the spindle 49 extending between. The mechanical arrangement is otherwise similar to the mechanism previously described. One cam 47 engages collar 46 with a return bias provided by torsion spring 44; at the other end, cam 47A engages collar 46A with bias provided by torsion spring 44A.

Spindle 49 also carries spigots 57 along its length, spaced and separated so as to receive the eyelets of guitar strings 55. Thus, rotation of spindle 49 will cause the tension on all the string to increase, so as to produce a vibrato effect when played. The collar, cam and torsion spring arrangement will accurately return the device and allow for a smooth playing action.

It will be appreciated that the present invention may be implemented in many different ways, and in combination with various features known and yet to be developed in relation to guitars and other instruments.

The invention claimed is:

1. A manual vibrato control device adapted to generate rotational data for use with an electronic pitch modification system, the vibrato control device comprising a rotatable shaft, a raised cam section on the shaft, first and second collars received on the shaft either side of the cam section, each collar being rotatable relative to the shaft and having a resilient bias urging it towards a central position, the bias of the first collar being rotationally opposite to the bias of the second collar, the first and second collars engaging the cam section engaging at respective surfaces, such that as the shaft rotates in a first direction, it receives a return force from the first collar but does not rotate the second collar, and that as the shaft rotates in a second, opposite direction, it receives a return force from the second collar but does not rotate the first collar.

2. A device according to claim 1, wherein the device includes first and second torsion springs to provide the resilient bias for the first and second collars.

3. A device according to claim 1, wherein the shaft includes a rotational sensor, so that operatively rotation of the shaft causes the rotational sensor to generate data on the extent and direction of rotation.

4. A device according to claim 3, wherein the rotational sensor comprises first and second magnets arranged in or adjacent to the shaft, the first and second magnets having oppositely directed polarities, and a Hall effect sensor positioned stationary relative to the rotation of the shaft, such that operatively the magnets rotate with the shaft relative to the Hall effect sensor, and the Hall effect sensor measures changes in the value and polarity of the magnetic field in order to produce rotation data indicative of the rotational position of the shaft.

5. A device according to claim 3, wherein the rotation data is output to a processor, said processor processing said rotation data so as to produce data indicative of degree of required pitch change for use in a pitch modification system.

6. A device according to claim 5, further including a pitch modification system.

7. A device according to claim 1, wherein the shaft is adapted to be connected to a vibrato control for operation by a musician.

8. A device according to claim 1, wherein the device is adapted to be affixed to a musical instrument.

9. A device according to claim 1, further including attachments for retaining guitar strings disposed along the shaft.

10. A device according to claim 9, wherein the attachments are disposed between the first and second cam sections.

11. A method for returning a manual vibrato device to a central position, the manual vibrato device comprising a rotatable shaft, a raised cam section on the shaft, first and second collars received on the shaft either side of the cam section, each collar being rotatable relative to the shaft, the method comprising:

a) providing a resilient rotational bias to the first collar urging it to the central position, and providing an opposite resilient rotational bias to the second collar urging it to the central position;

b) providing shaped engagement surface on the cam section and the corresponding surfaces of the first and second collars;

c) so that when the shaft is rotated in a first direction, it receives a return force from the first collar but does not rotate the second collar, and when the shaft is rotated in the second, opposite direction, it receives a return force from the second collar but does not rotate the first collar.

12. A method according to claim 11, wherein the rotational bias for the first and second collars is provided by respective first and second torsion springs.

13. A method according to claim 11, wherein the vibrato device is adapted to generate rotational data for use with an electronic pitch modification system, and the device further includes a rotational sensor, so that operatively rotation of the shaft causes the rotational sensor to generate data on the extent and direction of rotation.

* * * * *